US009716326B2

(12) United States Patent
Tamai

(10) Patent No.: US 9,716,326 B2
(45) Date of Patent: Jul. 25, 2017

(54) ELECTRICAL CONNECTOR

(71) Applicant: Hirose Electric Co., Ltd., Tokyo (JP)

(72) Inventor: Nobuhiro Tamai, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 14/964,683

(22) Filed: Dec. 10, 2015

(65) Prior Publication Data

US 2016/0172780 A1 Jun. 16, 2016

(30) Foreign Application Priority Data

Dec. 12, 2014 (JP) ..... 2014-252282

(51) Int. Cl.
*H01R 13/73* (2006.01)
*H01R 12/73* (2011.01)
*H01R 12/71* (2011.01)

(52) U.S. Cl.
CPC ..... *H01R 12/73* (2013.01); *H01R 12/712* (2013.01)

(58) Field of Classification Search
CPC ..... H01R 12/73; H01R 12/712
USPC ..... 439/540.1, 74, 108, 570, 701, 733.1
See application file for complete search history.

(56) References Cited

U.S. PATENT DOCUMENTS 4,664,309 A * 5/1987 Allen ..... B23K 3/06 228/175
4,668,032 A * 5/1987 Bouvier ..... H05K 3/3426 439/656
5,120,256 A * 6/1992 Walden ..... H01R 12/707 439/553
5,904,581 A * 5/1999 Pope ..... H01R 12/716 439/74
6,012,949 A * 1/2000 Lok ..... H01R 12/707 439/570
6,638,106 B1 * 10/2003 Wu ..... H01R 12/7064 439/567
7,048,576 B2 * 5/2006 Nakano ..... H01R 12/707 439/566
8,961,215 B2 * 2/2015 Hasegawa ..... H01R 9/091 439/346

(Continued)

FOREIGN PATENT DOCUMENTS

JP H07-161406 A 6/1995
JP H10-340764 A 12/1998

(Continued)

*Primary Examiner* — Abdullah Riyami
*Assistant Examiner* — Nelson R Burgos-Guntin
(74) *Attorney, Agent, or Firm* — Kubotera & Associates, LLC

(57) ABSTRACT

An electrical connector includes a plurality of connecting members arranged in an arrangement direction in parallel to a circuit board; and a joining member extending in the arrangement direction over an arrangement range of the connecting members for holding the connecting members. Each of the connecting members includes a terminal to be connected to a mating connector, and a terminal holding member for holding the terminal. The connecting members are arranged so that the connecting members arranged adjacently form a gap in between. The joining member is formed of a material having a coefficient of thermal expansion the same as that of the circuit board.

7 Claims, 14 Drawing Sheets

(56) References Cited

U.S. PATENT DOCUMENTS

2016/0172780 A1* 6/2016 Tamai ..... H01R 12/73
439/733.1

FOREIGN PATENT DOCUMENTS

JP H11-003752 A 1/1999
JP 2011-060590 A 3/2011

* cited by examiner

ELECTRICAL CONNECTOR

BACKGROUND OF THE INVENTION AND RELATED ART STATEMENT

The present invention relates to an electrical connector for a circuit board, which is to be mounted on a mounting surface of a circuit board with soldering.

Generally speaking, an electrical connector for a circuit board (hereinafter, simply referred to as a connector) is to be mounted on a mounting surface of a circuit board by reflow soldering of the connector thereto while disposing on the circuit board. Upon mounting by soldering, when a conventional connector is heated, deformation of a housing of the connector, such as warping and twisting, may occur due to difference in coefficients of thermal expansion between the housing and the circuit board. For example, when the housing has an outer shape of a rectangular parallelepiped, the housing may undergo deformation such as concave warping, in which both ends of the housing in a longitudinal direction thereof are lifted, or convex warping, in which a middle part of the housing in the longitudinal direction, is lifted.

Once the housing is deformed in this way, in the lifted part of the housing, connecting portions of terminals therein (portions to be soldered to a circuit part on the mounting surface of the circuit board) could come off from the circuit portion. As a result, disconnection may occur between the connecting portions and the circuit portion even after the reflow soldering. In addition, after the reflow soldering, if the melted solder is cooled to a certain temperature (e.g., 220° C.), the solder is hardened before the housing recovers an original shape thereof from the warping. Accordingly, the connecting portions of the terminals are fixed onto the circuit portion of the circuit board, while the housing is still warped. Moreover, once the housing is further cooled to room temperature, the housing will further try to recover the original shape from the warping. As a result, in the soldering parts of the connecting portions of the terminals and the circuit portion of the circuit board, a residual stress is generated, which may results in destruction of the portions that are mounted by soldering.

Therefore, upon mounting the conventional electrical connector onto the circuit board by soldering, it is necessary to minimize the influence of the deformation of the connector produced by the reflow soldering on the soldering parts for the mounting.

Patent Reference: Japanese Patent Application Publication No. 2011-060590

In the conventional electrical connector described in Patent Reference, a sheet metal member is attached on an upper surface of the connector, which is on the side opposite to the mounting surface. In this state, the connector is mounted on the circuit board by soldering, so that it is achievable to surely restrain the warping of the housing. More specifically, the sheet metal members have flexible portions in areas that correspond to both ends of the rectangular parallelepiped housing in the longitudinal direction. The flexible sections can easily flex in their sheet-thickness direction. Upon mounting the connector on the circuit board by soldering, when the both ends of the housing are heated and become lifted, it is achievable to restrict the warping of the housing with a counterforce (a spring force) that works downward to the ends from the flexible portions.

In the conventional electrical connector disclosed in Patent Reference, upon mounting the conventional connector by soldering, it is necessary to separately provide the sheet metal members having the flexible portions, and remove the sheet metal members after the mounting by soldering. In addition, there remains the difference in the coefficients of thermal expansion between the housing of the connector and the circuit board. Therefore, it is still necessary to avoid generation of the stress that lifts the both ends of the housing upon mounting the conventional connector to the circuit board by soldering. For this reason, when the stress generated at the both ends becomes excessive, for example, due to a material, shape, etc. of the housing of the connector, there is a concern of not being able to restrict the warping of the housing even with the flexible portions of the sheet metal members.

In view of the problems described above, an object of the invention is to provide an electrical connector for a circuit board, which can minimize the deformation of the connector upon mounting by soldering, which is caused by a difference in coefficients of thermal expansion between the connector and the circuit board. As a result, it is achievable to satisfactorily keep the state of the terminals being mounted by soldering on a circuit portion of the circuit board. In addition, it is not necessary to use the sheet metal members as described in Patent Reference.

Further objects and advantages of the present invention will be apparent from the following description of the present invention.

SUMMARY OF THE PRESENT INVENTION

An electrical connector for a circuit board of the invention is to be mounted on a mounting surface of a circuit board by soldering.

According to a first aspect of the invention, the electrical connector for a circuit board includes a plurality of connecting members and a joining member. The connecting members are arranged in an arrangement direction, which is parallel to a mounting surface of the circuit board. The joining member extends in the arrangement direction over an arrangement range of the plurality of connecting members, and joins and holds the plurality of connecting members. Each of the connecting members has a terminal to be connected to a mating connector and a terminal holding member made of a resin to hold the terminal. Further, the connecting members are arranged to form a gap between side surfaces of the connecting members arranged adjacently. The joining member is made of a metal or a resin, which has the same coefficient of thermal expansion as that of a metal or a resin that composes the circuit board.

According to the first aspect of the invention, upon mounting the electrical connector of the invention on the circuit board by soldering, the connecting members, the joining member, and the circuit board are respectively thermally expanded. According to the first aspect of the invention, the joining member is made of the metal or the resin having similar coefficients of thermal expansion as that of the metal or the resin that composes the circuit board. Moreover, there is hardly any difference in the coefficients of thermal expansion between the joining body and the circuit board. Therefore, the amounts of thermal expansion are almost the same between the joining member and the circuit board. Accordingly, a residual stress due to the difference in the coefficients of thermal expansion will not occur or will hardly occur on the portions of the connecting members held by the joining members, which are to be mounted on the circuit board. Here, the word "similar" in "the similar coefficient of thermal expansion" does not mean only the exactly same coefficient of thermal expansion, but also means a coefficient of thermal expansion that is within an acceptable range, where the residual stress generated on the mounting portions is within an acceptable range for use of the connector.

Furthermore, according to a second aspect of the invention, the connecting members are joined and held by the joining member. Therefore, upon mounting the connector to the circuit board, the plurality of connecting members themselves thermally expand so as to respectively interpose the gaps therebetween with small thermal expansion in the arrangement direction of the connecting members. As described above, according to the second aspect of the invention, the electrical connector for a circuit board is composed by arranging the plurality of connecting members. Therefore, as the whole connector, the connecting members deform in the arrangement direction so as to disperse the deformation over the whole range in the arrangement direction. At this time, the plurality of connecting members is arranged with gaps therebetween. Accordingly, it is achievable to minimize generation of a contacting force between the connecting members thermally expanded. As a result, being different from a conventional electrical connector, in which a plurality of terminal is held with only a single housing, the connecting members will not deform by locally large thermal expansion.

According to the second aspect of the invention, when the thermal expansion of each of the connecting members is smaller than the dimension of the gap, even when each of the connecting members is in thermally expanded state, the adjacent connecting members will not contact each other. In addition, there will no residual stress generated in the portions to be mounted by soldering by the contacting force between connecting members. Moreover, even when the thermal expansion of each of the connecting members is large and the adjacent connecting members contact each other while being in the thermally expanded state, it is achievable to minimize the contacting force (an external force) that the connecting members receive, and in turn the residual stress occurred in the portions mounted by soldering.

According to the second aspect of the invention, the plurality of connecting members may be arranged with spaces that are greater than the thermal expansion of the connecting members by mounting on the circuit board in the arrangement direction of the connecting members. Arranging the connecting members with spaces of certain dimension as described above, upon mounting the connector on the circuit board by soldering, each of the connecting members will thermally expand within the range of the space in the arrangement direction. As a result, the adjacent connecting members will not contact each other. Therefore, it is surely possible to prevent generation of the residual stress at the soldering portions of the connector's housing to mount on the circuit board by soldering.

According to a third aspect of the invention, each of the connecting members may have the terminal holding member, which has a protruding portion on a side surface thereof. The protruding portion protrudes in the arrangement direction of the connecting members. As a result, the protruding portions of the adjacent connecting members contact each other and physically restrict displacement of the connecting members.

At this point, according to a fourth aspect of the invention, a pair of protruding portions of the adjacent connecting members may be configured such that one protruding portion contacts the other protruding portion on a sloped surface tilted relative to the arrangement direction of the connecting members, when viewed in a direction perpendicular to the mounting surface of the circuit board. With the configuration that the protruding portions contact each other on the sloped surface, upon mounting the connector onto the circuit board by soldering, even when the connecting members thermally expand in the arrangement direction and the protruding portions contact each other, the contacting force will be dispersed also in a direction perpendicular to the arrangement direction. As a result, it is achievable to further reduce the external force (a contacting force), and in turn the residual force at the soldering portions to mount.

According to a fifth aspect of the invention, each of the connecting members may have a plurality of the protruding portions respectively on both side surfaces. When viewed in the arrangement direction of the connecting members, at least one protruding portion on one side surface may be provided on a different position from that of the protruding portion of the other side surface. With the protruding portions provided in different positions in this way, upon mounting the connector by soldering, in each connecting member, it is achievable to avoid transmission of the contacting force (the external force) received from the adjacent connecting member by thermal expansion in the arrangement direction to the adjacent connecting member. For example, when the protruding portion on one side surface receives contacting force from the protruding portion of the adjacent connecting member, there is no protruding portion on the other surface of the connecting member that receives the contacting force at a position corresponding to the one side surface. Therefore, the contacting force will not be transmitted to the adjacent connecting member that is next to the other side surface of the one connecting member, and will be dispersed in the direction along the other side surface. As a result, it is achievable to further reduce the external force (contacting force) that is exerted on the connecting member in the arrangement direction, and in turn the residual stress at the soldering portions to mount.

According to the invention, the joining member is made of the metal or the resin that has the similar coefficient of thermal expansion. As a result, it is achievable to minimize the residual stress generated at the mounting portions of the connective bodies and the circuit board due to difference in the coefficients of thermal expansion by mounting the connector on the circuit board by reflow soldering. In addition, the plurality of connecting members is joined and held by the joining member. Therefore, the connecting members deform with small thermal expansion over the whole range in the arrangement direction of the connecting members. At this time, the plurality of the connecting members is arranged with the gaps in between. Accordingly, it is achievable to minimize generation of the contacting force between the thermally expanded connecting members. As a result, there is no unsatisfactory mounting of terminals and the circuit section of the circuit board, it is achievable to secure satisfactory state of being mounted by soldering.

BRIEF DESCRIPTION OF THE DRAWINGS

FIGS. 2(A) and 2(B) are perspective views showing a receptacle connector of FIG. 1, wherein FIG. 2(A) shows a state that receptacle-side joining members that are separated from the receptacle connector of FIG. 1, and FIG. 2(B) shows an partial enlarged view of the receptacle-side joining member of FIG. 2(A);

FIGS. 3(A) and 3(B) are perspective views showing a plug connector of FIG. 1, wherein FIG. 3(A) shows the plug connector of FIG. 1 that is flipped upside down, and FIG. 3(B) shows grounding plates and plug-side joining members that are separated from the plug connector of FIG. 3(A);

FIGS. 4(A) and 4(B) are perspective views showing a part of the receptacle connector of FIG. 1 and a part of the plug connector that corresponds to the part of the receptacle connector, wherein FIG. 4(A) shows a state before fitting the connectors, and FIG. 4(B) shows a state that the plug connector of 4(A) is flipped upside down;

FIGS. 5(A) and 5(B) are views showing a part of the receptacle connector of FIG. 1, wherein FIG. 5(A) shows a perspective view of a part of the receptacle connector, from which a casing body is separated, and FIG. 5(B) shows a sectional views of the receptacle connector taken at a surface perpendicular to a width direction of the receptacle connector, which is near the ends of the casing bodies in the connector's width direction;

FIGS. 6(A) and 6(B) are perspective views showing receptacle terminals, wherein FIG. 6(A) shows the receptacle terminals held in a receptacle-side connecting member and FIG. 6(B) shows the receptacle terminal to be held in the receptacle-side connecting member;

FIGS. 7(A) and 7(B) are views showing the receptacle-side connecting member of FIG. 6(A), wherein FIG. 7(A) shows a front view of the receptacle-side connecting member viewed from the side of a short grounding plate, and FIG. 7(B) shows a back view of the receptacle-side connecting member viewed from the side of a long grounding plate;

FIGS. 8(A) to 8(C) are sectional views showing the receptacle-side connecting member of FIG. 7(A), wherein FIG. 8(A) shows the sectional view taken at a line A-A of FIG. 7(A), FIG. 8(B) shows the sectional view taken at a line B-B of FIG. 7(A), and FIG. 8(C) shows the sectional view taken at a line C-C of FIG. 7(A);

FIGS. 9(A) and 9(B) are perspective views showing the grounding plates that are to be held by the receptacle-side connecting member, wherein FIG. 9(A) shows a long grounding plate and FIG. 9(B) shows a short grounding plate;

FIG. 11(A) through 11(C) are views showing the plug connector of FIG. 4(B), wherein FIG. 11(A) shows a side view of the plug connector viewed in a connector's width direction, FIG. 11(B) shows a sectional view of the plug connector at a position of signal terminals, which is taken at a surface perpendicular to the connector's width direction of the plug connector of FIG. 4(B), and FIG. 11(C) shows a sectional view of the plug connector at a position of grounding terminals, which is taken at a surface perpendicular to the connector's width direction of the plug connector of FIG. 4(B);

FIGS. 12(A) and 12(B) are sectional views showing the electrical connector assembled component of FIG. 4(A), wherein FIG. 12(A) shows a state before fitting the connectors and FIG. 12(B) shows a state after fitting the connectors;

FIG. 13(A) through 13(C) are sectional views showing the electrical connector assembled component in a floating state, wherein FIG. 13(A) shows the sectional view taken at a position of the signal terminals, FIG. 13(B) shows the sectional view at a position between signal terminals, and FIG. 13(C) shows the sectional view at a position near ends of the casing bodies.

DETAILED DESCRIPTION OF THE PREFERRED EMBODIMENTS

Hereunder, embodiments of the present invention will be described with reference to the accompanying drawings.

First Embodiment

Figure 1:
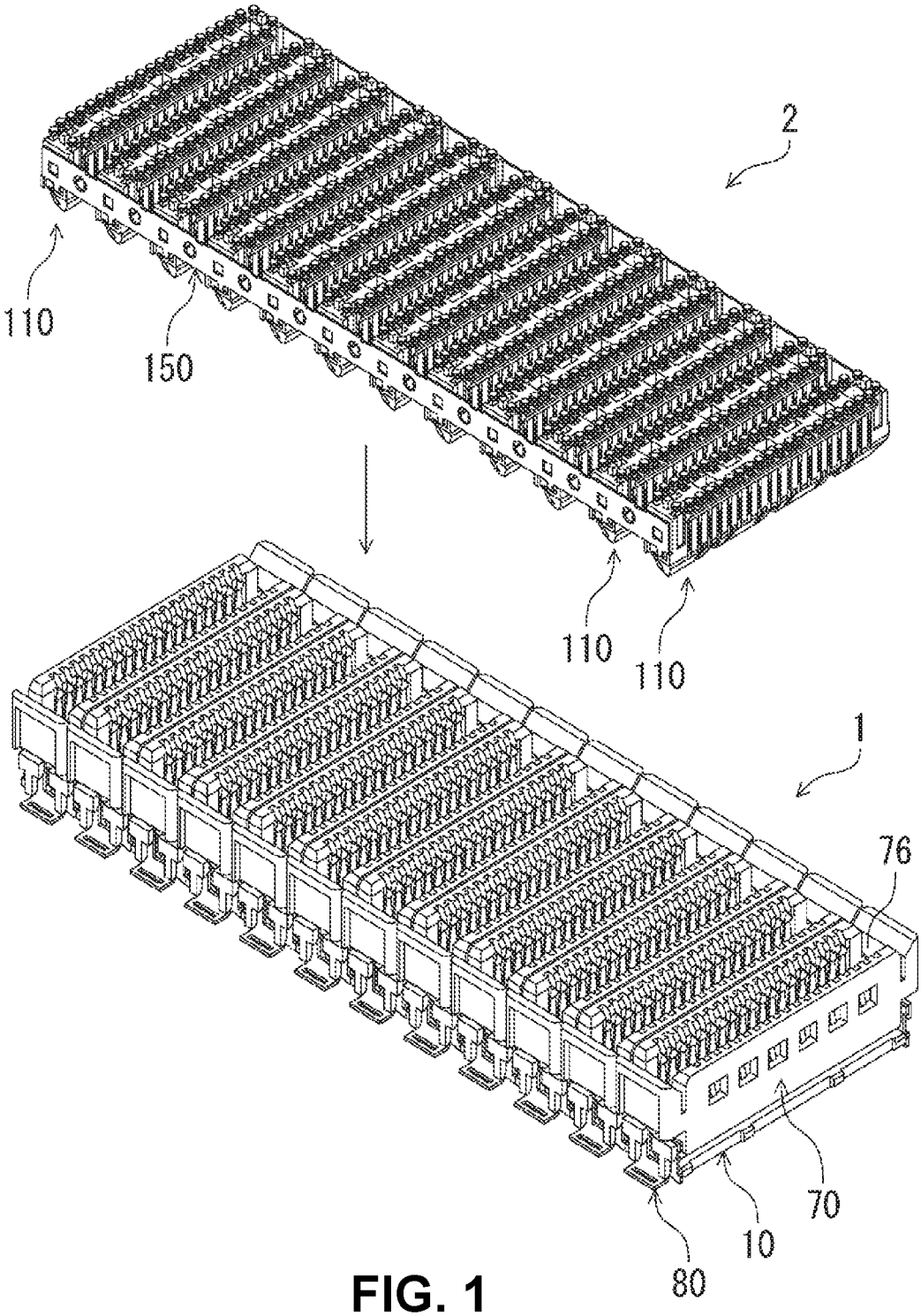
FIG. 1 is a perspective view showing an electrical connector assembled component according to a first embodiment of the invention, which shows a state before fitting connectors.

FIG. 1 is a perspective view of an electrical connector assembled component according to a first embodiment of the invention, which shows a state before fitting connectors; According to the first embodiment, the connector assembled component includes a receptacle connector 1 and a plug connector 2, which are fit to connect each other. The receptacle connector 1 and the plug connector 2 are electrical connectors for circuit boards, which are to be disposed on mounting surfaces of different circuit boards. The receptacle connector 1 and the plug connector 2 are fit to connect each other, having a direction perpendicular to the mounting surfaces of the respective circuit boards (an up-and-down direction in FIG. 1) as an insertion/removal direction thereof.

In the description of this embodiment below, a "connector fitting direction" is set as a direction of fitting the plug connector 2 to the receptacle connector 1, i.e., a direction of moving the plug connector 2 downward in FIG. 1, and a "connector removal direction" is set as a direction opposite thereto, i.e., an upward direction in FIG. 1.

The circuit boards to mount the receptacle connector 1 and the plug connector 2 are respectively composed so as to have a circuit portion made of metal disposed on a surface or inside of a sheet member made of resin. As a material of such sheet member, for example, a general material such as so-called FR4, which is glass fiber fabric impregnated with epoxy resin, may be used. As a material of the circuit portion, for example, general copper alloy such as phosphor bronze may be used.

[Configuration of the Receptacle Connector 1]

As shown in FIG. 1, the receptacle connector 1 of the embodiment has an outer shape of a rectangular parallelepiped, which extends in one direction parallel to a mounting surface of a circuit board (not illustrated) as a longitudinal direction. The receptacle connector 1 includes a plurality of receptacle-side connecting members 10, casing bodies 70, and two receptacle-side joining members 80 (see also FIG. 2). The plurality of receptacle-side connecting members 10 is arranged in the longitudinal direction of the receptacle connector. Each casing body 70 accommodates one set of two receptacle-side connecting members that are adjacent to each other. The two receptacle-side joining members 80 extend in the arrangement direction over the range the plurality of receptacle-side connecting members 10 are arranged. In addition, the two receptacle-side joining members 80 join and hold the plurality of receptacle-side connecting members 10. The receptacle connector 1 receives fitting portions (fitting walls that will be described later (see FIGS. 4(A) and 4(B)) of plug-side connecting members 110 provided in the plug connector 2 at spaces (receiving portions 76 that will be described later) between the two receptacle-side connecting members 10 that are to be accommodated in the casing bodies 70.

As is well shown in FIG. 4(A), each receptacle-side connecting member 10 has a plurality of receptacle terminals 20, two terminal holding members (a stationary holding body 30 and a movable holding body 40, which will be described later), and two grounding plates (a long grounding plate 50 and a short grounding plate 60, which will be described later). The plurality of the receptacle terminals 20 is arranged in a connector's width direction, which is a lateral direction of the receptacle connector 1. The two terminal holding members arrange and hold the plurality of receptacle terminals 20 by being integrally molded therewith. The two grounding plates are disposed in the arrangement direction of the receptacle-side connecting members 10, so as to face each other having the receptacle terminals therebetween. According to the embodiment, the receptacle-side connecting members 10 that are adjacent to each other in the arrangement direction are disposed to be symmetrical to each other.

Figure 6:
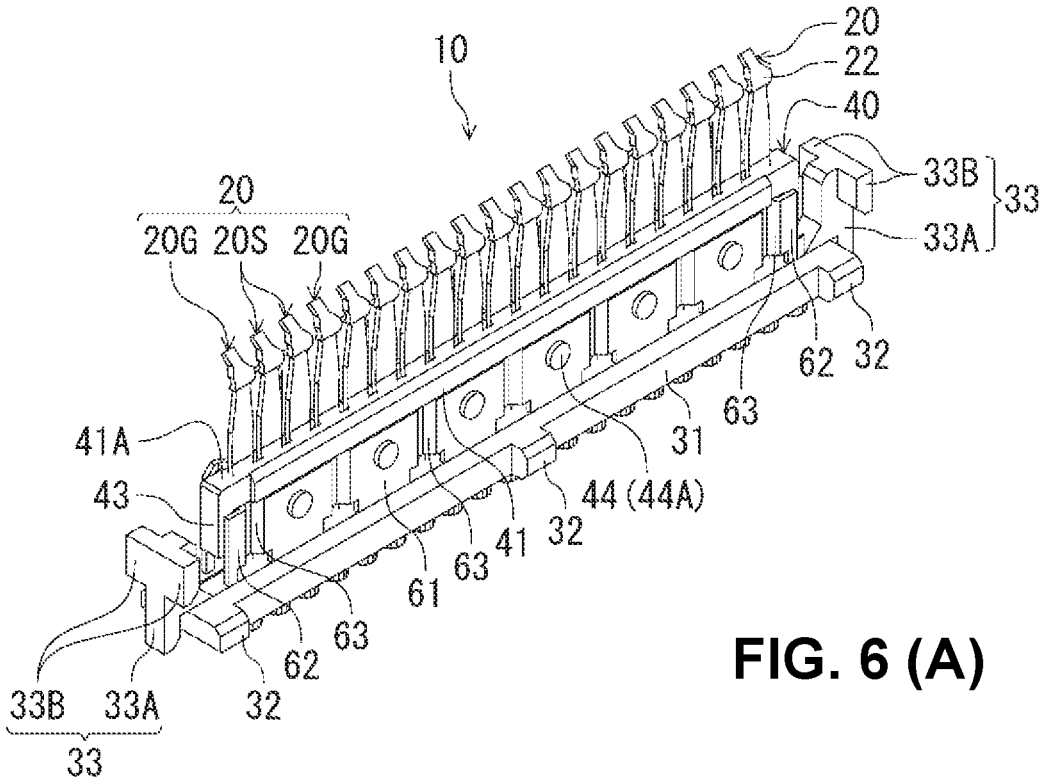
Figure 6:
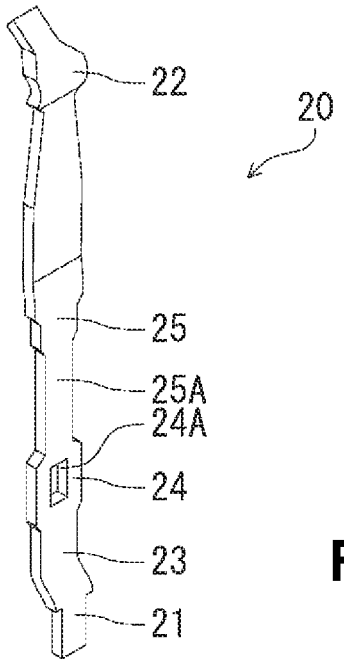

As is well shown in FIG. 6(B), each receptacle terminal 20 is made by bending a metal strip piece, which extends in an up-and-down direction, in a plate's thickness direction. Each receptacle terminal 20 has a connecting portion 21 at a lower end (one end) and a contact portion 22 at an upper end (the other end). The connecting portions 21 are to be connected to a circuit portion of a mounting surface of a circuit board by soldering. The contact portions 22 contact with plug terminals 130 provided on the plug connector 2 Moreover, each receptacle terminal 20 has at its lower half part a lower portion to be held 23, a deformable portion 24, and an upper portion to be held 25. The lower portion to be held 23 is adjacent to the connecting portion being right thereabove. The deformable portion 24 is adjacent to the lower portion to be held 23 being right thereabove. The upper portion to be held 25 is adjacent to the deformable portions 24 being right thereabove.

As shown in FIGS. 5(A), 6(A), 7(A), and 7(B), according to the embodiment, among the plurality of receptacle terminals 20 arranged and held by the respective receptacle-side connecting members 10, a part of the receptacle terminals 20 serve as signal terminals 20S and the rest of the receptacle terminals 20 serve as grounding terminals 20G. The signal terminals 20S and the grounding terminals 20G are arranged in a specified order. According to the embodiment, the grounding terminals 20G are arranged on both sides of a pair of signal terminals 20S that are adjacent each other. To the pair of signal terminals 20S, high-speed differential signals that are paired to each other are to be transmitted. Hereunder, when the receptacle terminals 20 need to be specifically described as the signal terminals 20S or the grounding terminals 20G, "S" will be affixed to reference numerals of each portion of the signal terminals 20S and "G" will be affixed to referential numerals of each portion of the grounding terminals 20G.

Figure 8:
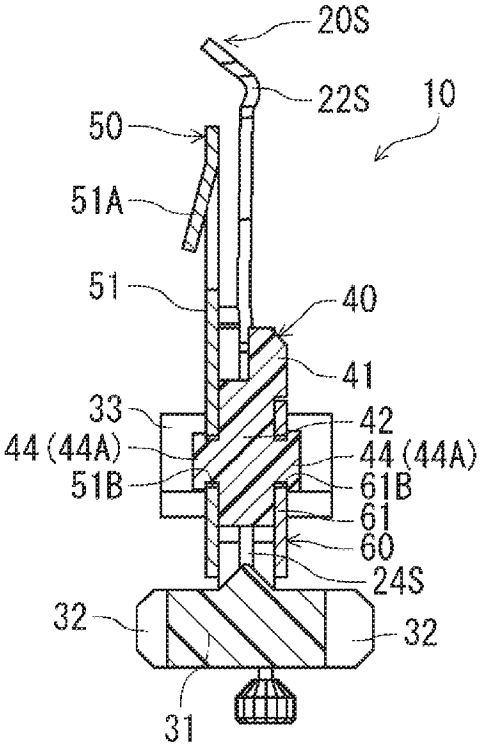
Figure 8:
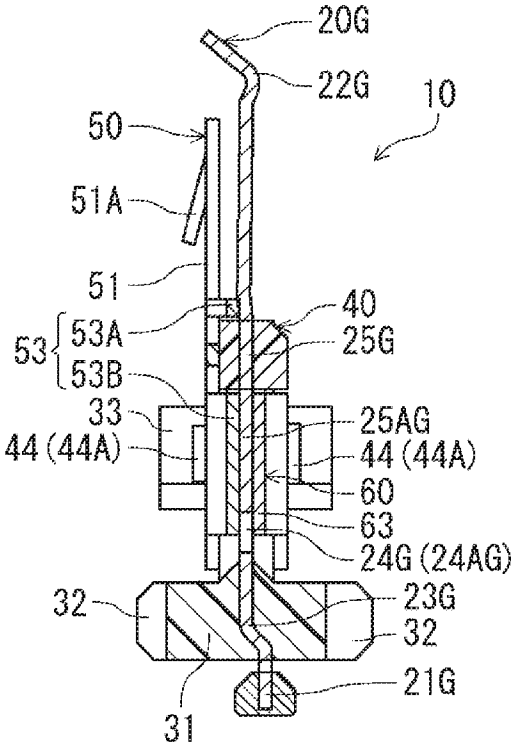
Figure 8:
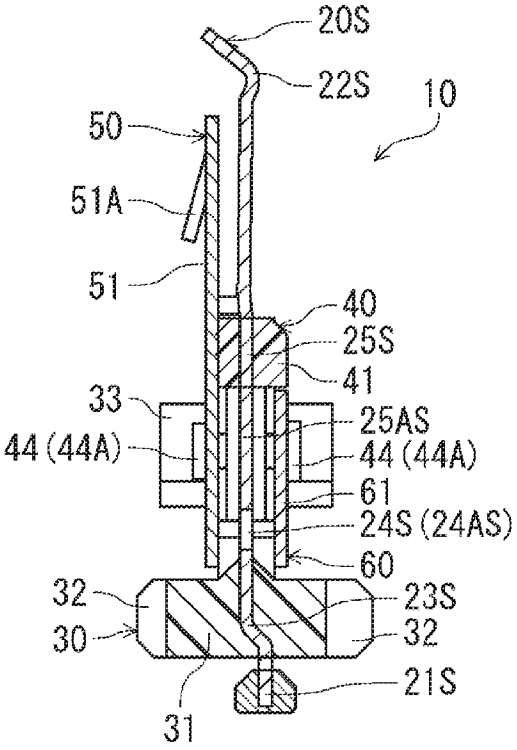

As shown in FIGS. 8(A) and 8(B), the contact portions 22 are formed to convexly curve in a sheet thickness direction of the receptacle terminals 20 and have elasticity in the sheet thickness direction. The contact portions 22 contact with the plug terminals 130 at their convexly curved sheet surface with certain contact pressure. The contact portions 22 are formed wider than contact portions 132 of the plug terminals 130 of the plug connector 2, which will be described later. The lower portions to be held 22 are parts to be held by the stationary holding bodies 30 as terminal holding members. Each lower portion to be held 23 is made by bending a lower portion thereof in the sheet thickness direction into a generally cranked shape. As shown in FIG. 6(B), the deformable portions 24 are formed to have width that is greater than those of the lower portions to be held 23 and the upper portions to be held 25, which will be described later. Each deformable portion 24 has a hole 24A penetrating in a center area in the width direction. With the hole 24A formed in this way, each deformable portion 24 can more easily deform in the sheet thickness direction than other areas in the receptacle terminal 20. The upper portions to be held 25 are parts to be held by a movable holding body 40, which serves as a terminal holding member and will be described later. As shown in FIG. 6(B), the lower half part of the upper portion to be held 25 is formed as a narrow portion 25 having smaller width than other areas in the receptacle terminal 20.

As described above, the connector assembled component of the embodiment is for transmitting high-speed signals. Therefore, it is strongly demanded to minimize impedance change, i.e., the impedance has to be matched, over the range of the receptacle terminals in the longitudinal direction. According to the embodiment, the lower portions to be held 23 are held by the stationary holding body 30, the upper portions to be held 25 are held by the movable holding body 40 by integral molding, and at least a part of their circumferential surfaces is covered. On the other hand, since the deformable portions 24 have to be deformable in the thickness direction, the deformable portions 24 are not held by the terminal holding members 30 and 40, and its whole circumferential surface is exposed to the air. Therefore, the deformable portions 24 tend to have greater impedance than those of the lower portions to be held 23 and the upper portions 25 to be held.

According to the embodiment, the deformable portions 24 have larger width than those of the lower portions to be held 23 and the upper portions 25 to be held so as to have smaller impedance. As a result, it is achievable to match the impedance of the deformable portions 24 with those of the lower portions to be held 23 and the upper portions to be held 25. Moreover, the deformable portions 24 have holes 24A within the range of the width thereof. Therefore, the deformable portions 24 can easily deform in their thickness direction, while keeping the deformable portions 24 wide to match the impedance. Accordingly, it is achievable to secure the both impedance matching and easy deformation of the deformable portions 24, so that the receptacle connector 1 of the embodiment can be used for transmission of high-speed signals.

According to the embodiment, with the holes 24A, the deformable portions 24 can easily deform. Alternatively, for example, the deformable portions 24 can have concave portions that are dented within the width range of the deformable portions 24 from the sheet surfaces of the deformable portions 24. In addition, when it is not necessary to strictly match the impedance, such as when frequencies of the signals to transmit are low, the deformable portions 24 may be formed to be narrower than those of adjacent areas so as to be easily deformable.

Moreover, according to the embodiment, any of the receptacle terminals 20 has the deformable portion 24. However, it is not essentially required for all the receptacle terminals 20 to have the deformable portion 24. For example, in the respective connecting members 10, only a part of the receptacle terminals 20 in a terminal row (a row of the receptacle terminals 20 arranged in the width direction of the receptacle terminals 20) can have the deformable portions 24. In this case, the rest of the receptacle terminals 20 in the terminal row have the same shape as that of the above-described part of the receptacle terminals 20, but do not have the hole 24.

According to the embodiment, each receptacle-side connecting member 10 has the terminal rows, in each of which the plurality of receptacle terminals 20 is arranged. However, it is not essentially required for each receptacle-side connecting member 10 to have a plurality of terminals. Instead, only one receptacle terminal may be provided in each receptacle-side connecting member 10 so as to use the receptacle terminal, for example, as a power terminal.

As the terminal holding members, there are stationary holding bodies 30, and movable holding bodies 40. Each stationary holding body 30 holds the lower portions to be held 23 of all the receptacle terminals 20 provided in one receptacle-side connecting member 10 together by integral molding. Each movable holding body 40 hold the upper portions to be held 25 of all the receptacle terminals 20 in one receptacle-side connecting member 10 together by integral molding. Each movable holding body can make angular displacement relative to the stationary holding body 30 in the receptacle-side connecting member 10, having the connector's width direction (terminals' width direction) as a rotational axis.

Figure 5:
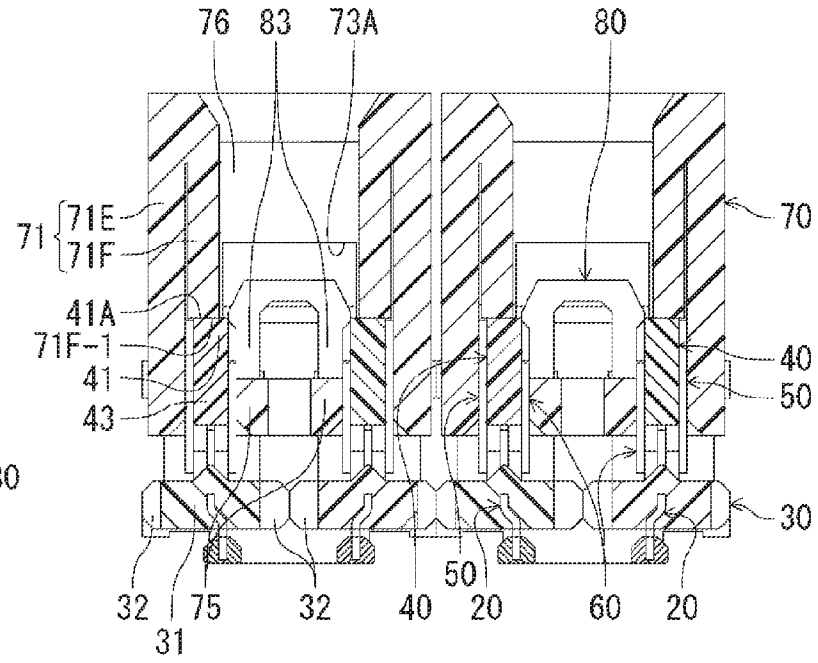
Figure 5:
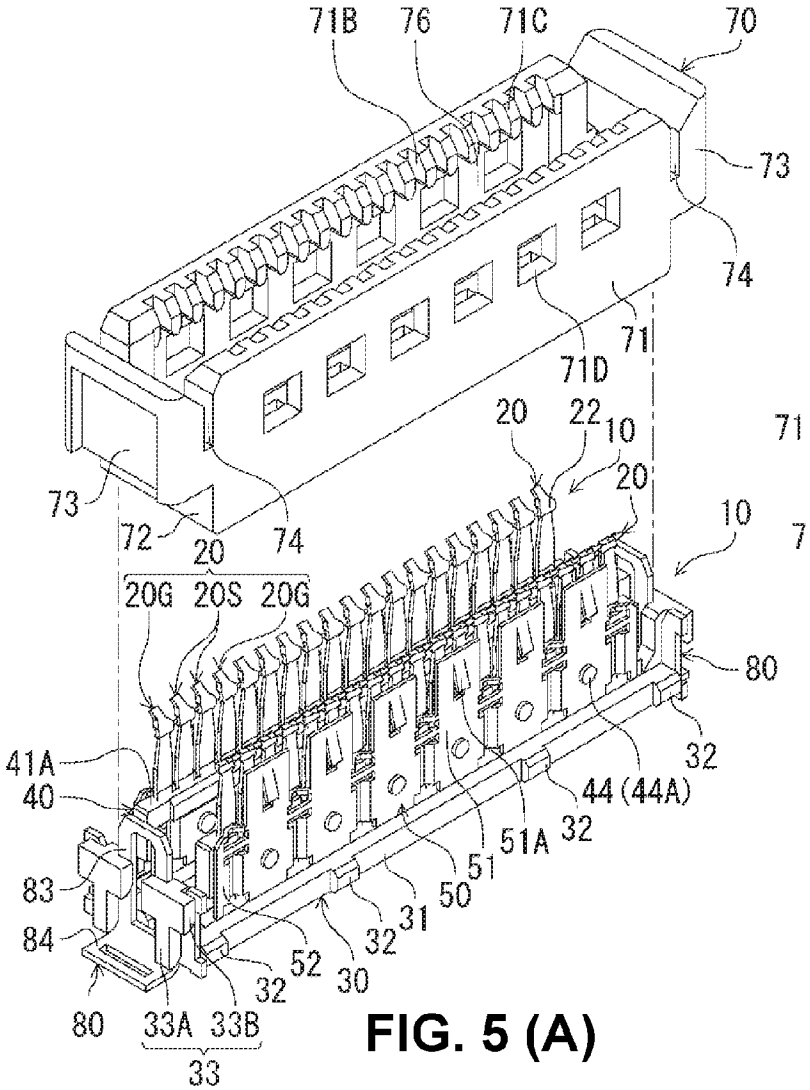

Each stationary holding body 30 is made of an electrically insulating material such as resin. As shown in FIGS. 5(A) and 6(A), each stationary holding body 30 extends in the connector's width direction, which is the arrangement direction of the receptacle terminals 20. Each stationary holding body 30 includes a holding portion 31, a plurality of protruding portions 32, and walls to be held 33. The holding portion 31 holds the lower portions to be held 23 of the receptacle terminals 20. Each of the plurality of protruding portions 32 has a shape of a rectangular parallelepiped. Each protruding portion 32 protrudes from the both side surfaces of the holding portions (flat surfaces perpendicular to the arrangement direction of the receptacle-side connecting members 10). The walls to be held 33 are joined to the both ends of the holding portion 31 in the connector's width direction and extends in the up-and-down direction.

Figure 7:
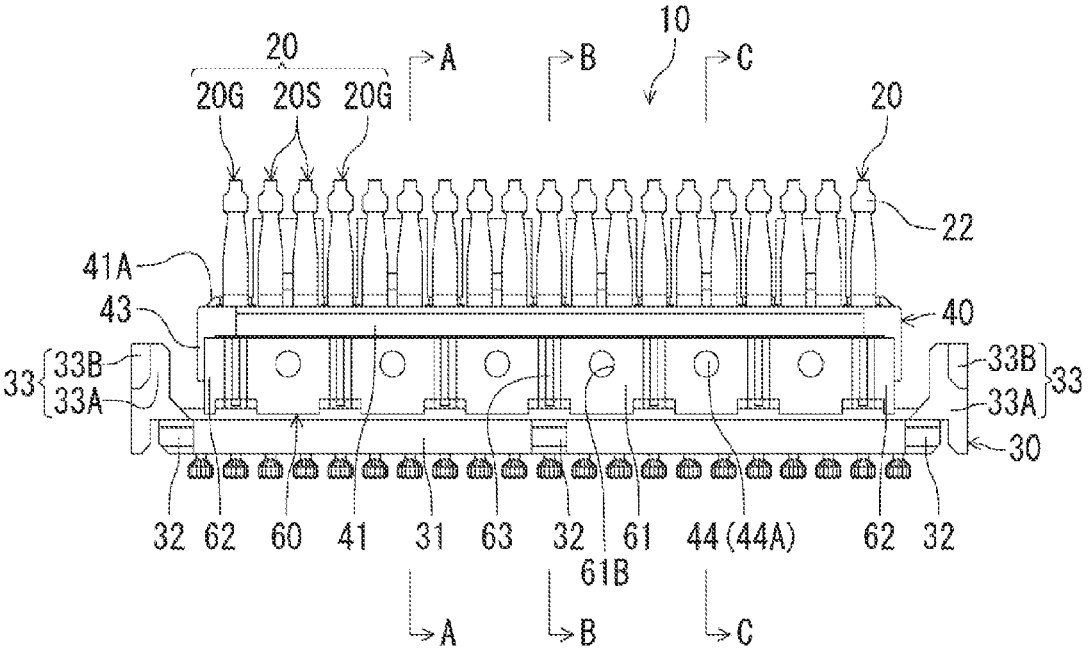
Figure 7:
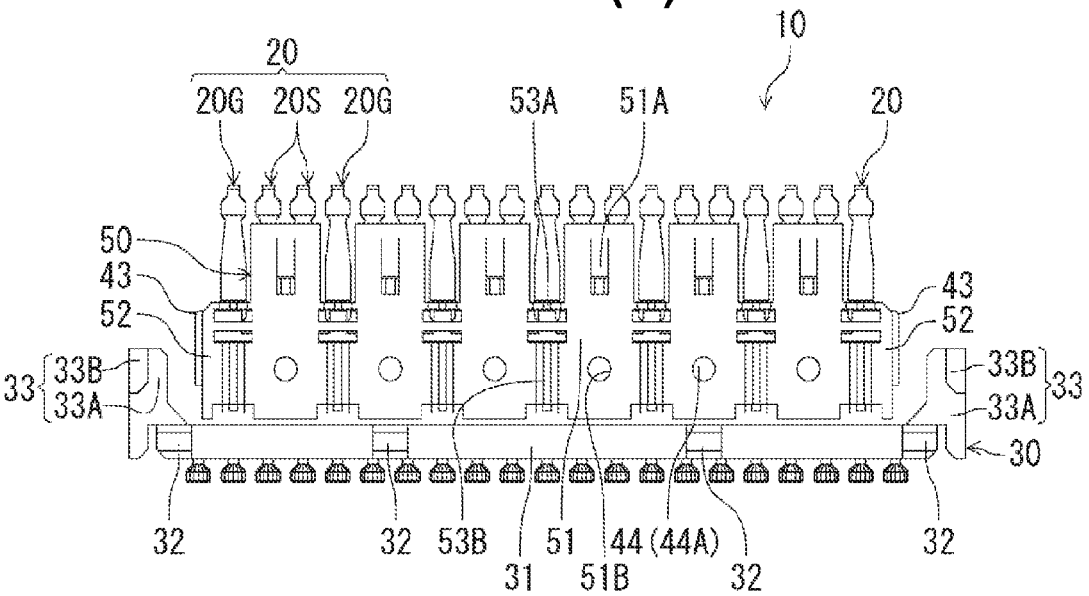
Figure 10:
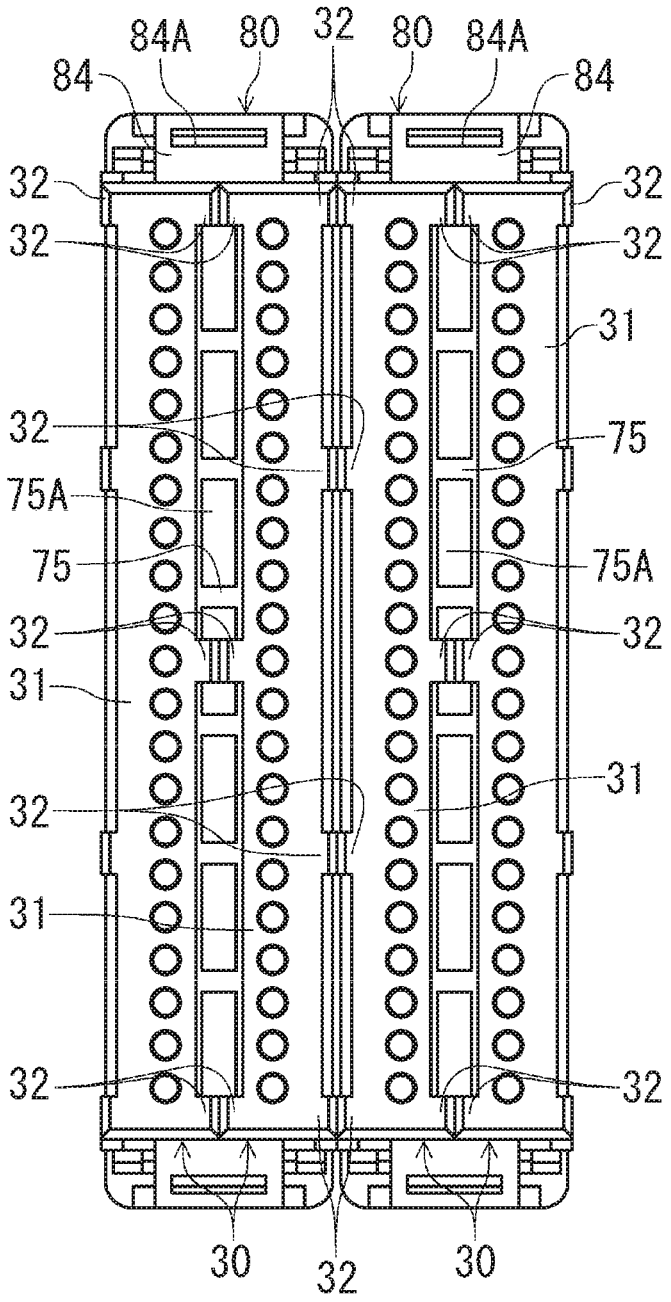
FIG. 10 is a bottom view of the receptacle connector of FIG. 4(A)

As is well shown in FIGS. 7(A) and 7(B), there are four protruding portions 32 formed on one side surface and three protruding portions 32 are formed on the other side surface (see also FIG. 10). The respective protruding portions 32 on each side surface are provided at the both end parts in the connector's width direction and at a middle part of the side surface in the connector's width direction so as to be at equal intervals. In other words, the protruding portions 32 on the one side surface and the protruding portions 32 on the other side surface are provided at the same positions at the both end parts, but at different positions at the middle part, when viewed in the arrangement direction of the connecting members (a perpendicular direction to the paper surface of FIGS. 7(A) and 7(B)) (see also FIG. 10).

As described above, according to the embodiment, adjacent receptacle-side connecting members 10 are disposed symmetrically to each other. Therefore, as shown in FIG. 10, in the adjacent receptacle-side connecting members, one side surfaces or the other side surfaces face each other. Those protruding portions 32 on the side surfaces that face each other respectively form pairs. Protruding top surfaces of each pair of the protruding portions 32 abut each other in the arrangement direction of the receptacle-side connecting members 10. As a result, it is achievable to restrict the positions of the receptacle-side connecting members 10 in the arrangement direction. The protruding portions 32 in each pair may have their protruding top surfaces abut each other before mounting the receptacle connector 1 by soldering (see FIG. 10), or there may be formed slight gaps between the protruding top surfaces.

As shown in FIGS. 7(A) and 7(B), each wall to be held 33 has a flat portion to be held 33A and a restricting portion 33B. Each flat portion to be held 33A has a flat surface perpendicular to the arrangement direction of the receptacle terminals 20 and extends in the up-and-down direction. Each restricting portion 33B protrudes in the arrangement direction from the both upper flat surfaces of the portion to be held 33A (see also FIG. 5(A)). The flat portions to be held 33A are held being pressed from thereabove into the holding grooves 85 (see FIG. 2(B)) of the receptacle-side joining member 80. Moreover, as shown in FIGS. 7(A) and 7(B), the restricting portions 33B are positioned being close to outer ends of the flat surfaces of the flat portions to be held 33A in the connector's width direction. As shown in FIG. 5(A), by facing the flat surfaces of the receptacle-side joining members 80 at positions outside the receptacle-side joining members 80 in the connector's width direction, the restricting portions 33B restrict displacement of the receptacle-side connecting members 10 relative to the receptacle-side joining members in the connector's width direction.

Each of the movable holding bodies 40 is made of an electrically insulating material such as resin and includes a base holding portion 41, a plurality of lower holding portions 42, and end holding portions 43. As shown in FIGS. 6(A), 7(A), and 7(B), the base holding portion 41 (see also FIG. 8(*c*)) extends over the whole arrangement range of the receptacle terminals 20 in the connector's width direction, which is an arrangement direction of the receptacle terminals 20. The base holding portion 41 holds all the receptacle terminals 20 thereon together. The plurality of lower holding portions 42 (see FIG. 8(C)) extends downward from the base holding portion 41 at positions having two adjacent signal terminals 20S therebetween in the connector's width direction. The end holding portions 43 extend downward at the both ends of the base holding portion 41 in the connector's width direction.

As shown in FIG. 6(A), the base holding portion 41 includes restraining surfaces 41A. The restraining surfaces 41A are formed on upper surfaces of the both ends of the base holding portion 41 in the connector's width direction. The restraining surfaces 41A restrict downward movement of the casing body 70 (see also FIG. 5(B)). The lower holding portions 42 are provided at positions so to have two signal terminals 20S between two adjacent lower holding portions 42. Each lower holding portion 42 holds side end portions (portions extending in the up-and-down direction) of the narrow portions 25A of the two signal terminals 20S, which are adjacent to each other. Each lower holding portion 42 covers the both sheet surfaces and the side end surfaces (sheet thickness surfaces) of the side end portions. In addition, each lower holding portion 42 includes a holding protruding portion 44. The holding protruding portions 44 protrude towards the arrangement direction from a sheet surface of the lower holding portion 42 (a surface perpendicular to the arrangement direction of the receptacle terminals 20). As will be described below, the holding protruding portions 44 hold the grounding plates 50 and 60 (see FIG. 8(C)). The end holding portions 43 hold side end portions outside the grounding terminals 20G provided at the both ends in the arrangement range of the terminals. Moreover, the protruding top portions of the holding protruding portions 44 serve as pressure-receiving portions 44A. The pressure-receiving portions 44A receive pressing force from the casing body 70 when the casing body 70 deforms, as will be described later (see FIG. 13(B)).

As described above, according to the embodiment, the receptacle connector 1 includes the plurality of receptacle-side connecting members 10 arranged therein. Each receptacle-side connecting member 10 has a row of terminals. In each row, the movable holding body 40 holds all the upper portions to be held 25 of the receptacle terminals 20 therein together. In other words, in case of a conventional connector, one holding body holds all terminals in a plurality of rows together. However, according to the connector of the invention, terminals in each row can displace from other rows of terminals.

According to the embodiment, as described above, in each receptacle-side connecting member 10, the movable holding body 40 holds all terminals in each row of terminals together. However, it is not essentially required to hold all the terminals together. For example, a plurality of terminals that compose the row of terminals can be held together by a set of a few terminals, or held individually.

Figure 9:
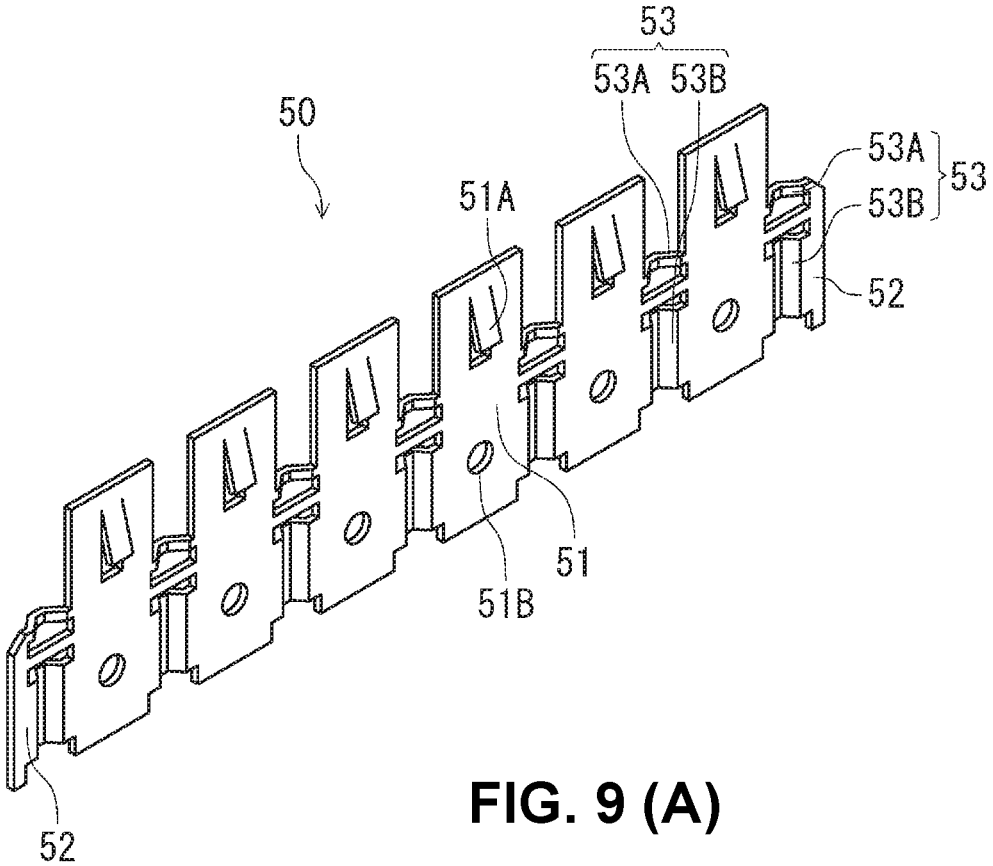
Figure 9:
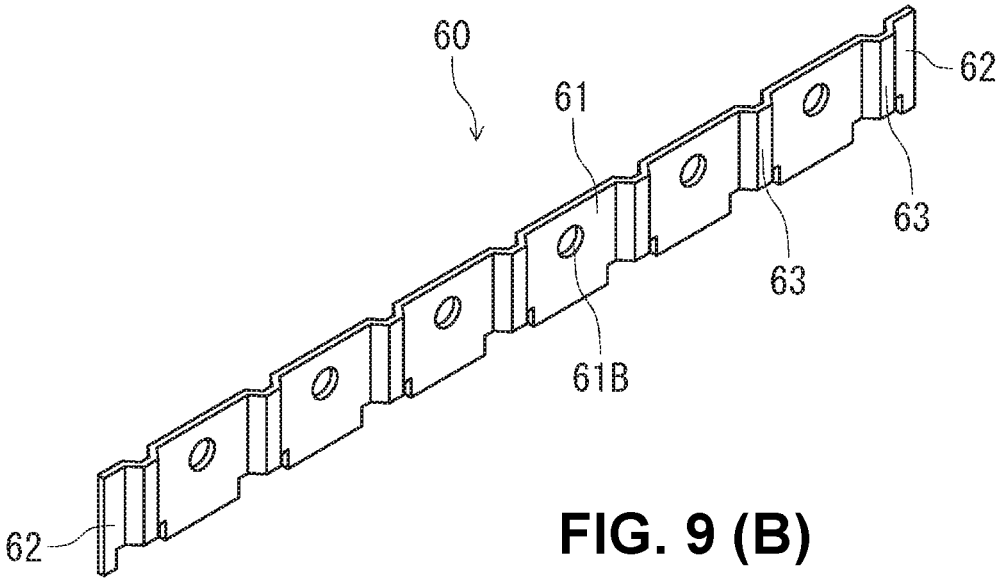

Each of the long grounding plates 50 is made by die-cutting of a sheet metal member and then bending in the sheet's thickness direction. As shown in FIGS. 5(A) and 9(A), each long grounding plate 50 includes a plurality of long covering flat portion 51, and a strip-like ends 52 that extend in the up-and-down direction at both side ends of the arrangement range of the long covering flat portions 51. Each grounding plate is composed by joining the long covering flat portions 51 to each other, and joining the strip-like ends 52 to long covering flat portions 51.

As shown in FIGS. 7(B) and 8(C), each of the long covering flat portions 51 extends so as to correspond to the range between the contact portions 22 and the lower portions to be held 23 of the receptacle terminals 20 in the up-and-down direction. In the connector's width direction, as is well shown in FIG. 7(B), each of the long covering flat portions 51 extends in the range that corresponds to two adjacent signal terminals 20S. As shown in FIG. 9(A), each of the long covering flat portions 51 has a cantilever-like attachment portion 51A at an upper half part thereof. Each of the attachment portions 51A is formed by cutting and lifting the portion so as to have a free lower end. The attachment portions 51A extend being lifted from the sheet surfaces of the long covering flat portions 51 and thereby being away from the receptacle terminals 20 as it goes downward. As a result, the attachment portions 51A are deformable in the sheet thickness direction. As will be described later, the attachment portions 51A serve as portion to attach to the casing bodies 70 (see FIG. 4(A)). Furthermore, each of the long covering flat portions 51 has a hole 51B, which penetrates in the sheet thickness direction, at a generally center area in a lower half part thereof. The holes 51B are to be held by the holding protruding portions 44 of the movable holding body 40 in each receptacle-side connecting member 10. The long grounding plates 50 are held by the movable holing body 40 being thermally melted (thermally crimped) while the holding protruding portions 44 of the movable holding bodies 40 are inserted in the holes 51B (see FIG. 8(C)).

As shown in FIG. 7(B), the strip-like ends 52 extend in the up-and-down direction in the range that corresponds to lower half of the long covering flat portion 51, so as to correspond to positions of the end-holding portions 43 of the movable holding body 40 in the connector's width direction.

As shown in FIGS. 5(A) and 9(A), the long covering flat portions 51 are joined each other and the long covering flat portions 51 and the strip-like ends 52 are joined each other, by joining portions at three positions in the up-and-down direction. As shown in FIG. 5(A), those joining portions are provided at positions of the grounding terminals 20G in the connector's width direction. Among them, the uppermost joining portions and the lowermost joining portions are bent to protrude towards the grounding terminals 20G in the sheet thickness direction. The protruding top surfaces (flat surfaces) thereof are formed as grounding contact portions 53 that contact with sheet surfaces of the grounding terminals 20G (see FIG. 8(B)). Hereunder, the grounding contact portions 53 at the uppermost positions are referred to as "upper grounding contact portions 53A", and the grounding contact portions 53 at the lowermost positions are referred to as "lower grounding contact portions 53B". More specifically, as shown in FIG. 8(B), the upper grounding contact portions 53A are provided corresponding to positions right above the upper portions to be held 25G of the grounding terminals 20G. The lower grounding contact portions 53B are provided corresponding to the range of the upper half portions and narrow portions 25A of the deformable portions 24G of the grounding terminals 20G in the up-and-down direction.

Similarly to the long grounding plates 50, the short grounding plates 60 are made by die-cutting a sheet metal member and bending in the sheet thickness direction. As is well shown in FIG. 9(B), each short grounding plate 60 has the same shape as that of the long grounding plate 50, but lacks the upper part than the grounding contact portions 53B of the long grounding plate 50. More specifically, each short grounding plate 60 includes a plurality of short covering flat portions 61 and strip-like ends 62 disposed at the ends of the arrangement range of the short covering flat portions 61. The short covering flat portions 61 are joined to each other and the short covering flat portions 62 and the grounding contact portions 63 are joined to each other, by grounding contact portions 63.

As shown in FIG. 7(A), each of the short covering flat portions 61 is provided over the range corresponding to two signal terminals 20S that are adjacent to each other in the connector's width direction. Each short covering flat portion 61 has a hole 61B, which penetrates in the sheet thickness direction. The short covering flat portions 61 are formed to be held by the holding protruding portions 44 of the movable holding body 40 through thermal fusion at positions that are slightly close to the upper ends thereof. Moreover, being different from the long covering flat portions 51, each short covering flat portion 61 does not have an attachment portion for its attachment to the casing body 70.

As shown in FIG. 7(A), the grounding contact portions 63 are provided in the range corresponding to the grounding terminals 20G in the connector's width direction. As shown in FIG. 8(B), the grounding contact portions 63 contact with sheet surfaces of the grounding terminals 20G at their protruding top surfaces (flat surfaces) that protrude towards the grounding terminals 20G.

Each casing body 70 is made of an electrically insulating material such as resin. In addition, each casing body 70 has an outer shape of a generally rectangular parallelepiped with the connector's width direction being its longitudinal direction. Each casing body 70 includes two side walls 71, two end walls 72, and walls to be restricted 73. The two side walls extend in the connector's width direction. The two end walls 72 extend in the arrangement direction of the receptacle-side connecting members 10 and join ends of the side walls 71. The walls to be restricted are adjacent to the end walls 72 at positions outside the end walls 72 in the connector's width direction, and are joined to outer surfaces of the respective end walls 72.

Figure 12:
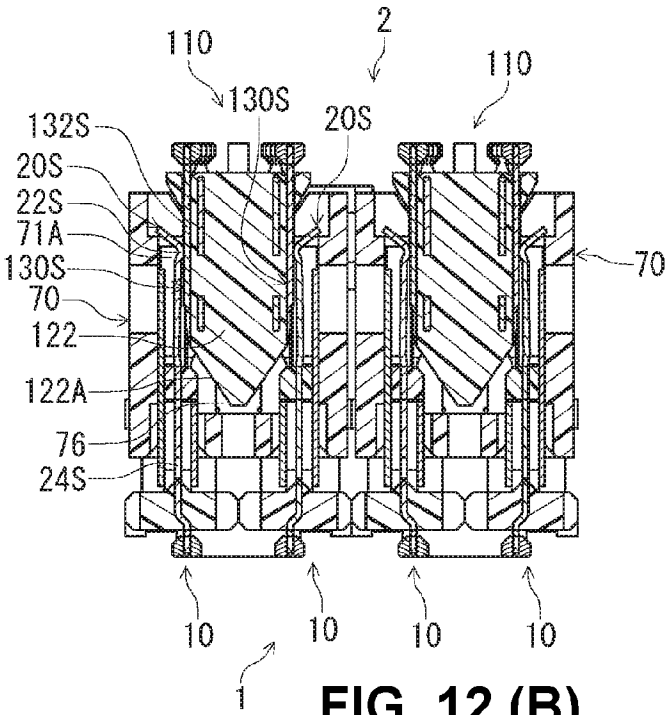
Figure 12:
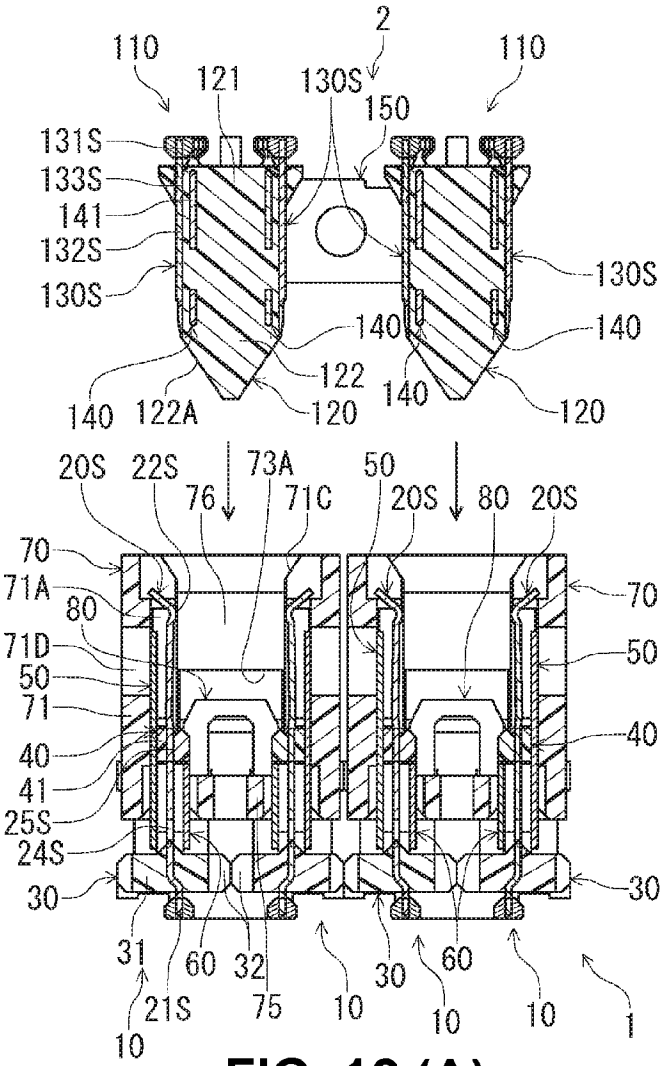
Figure 13:
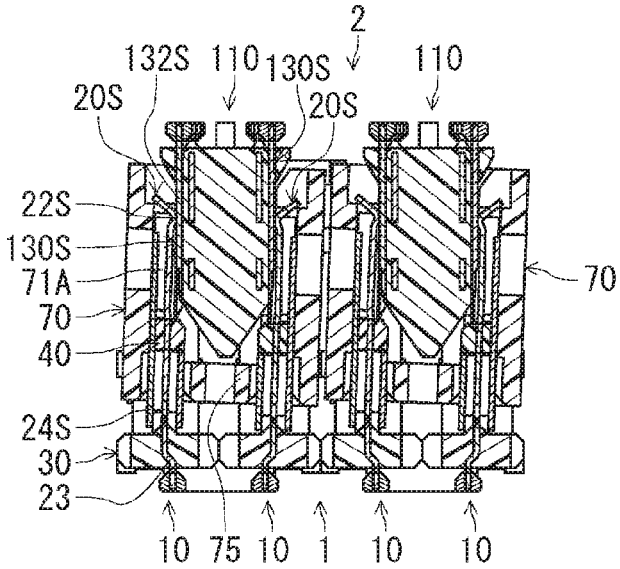
Figure 13:
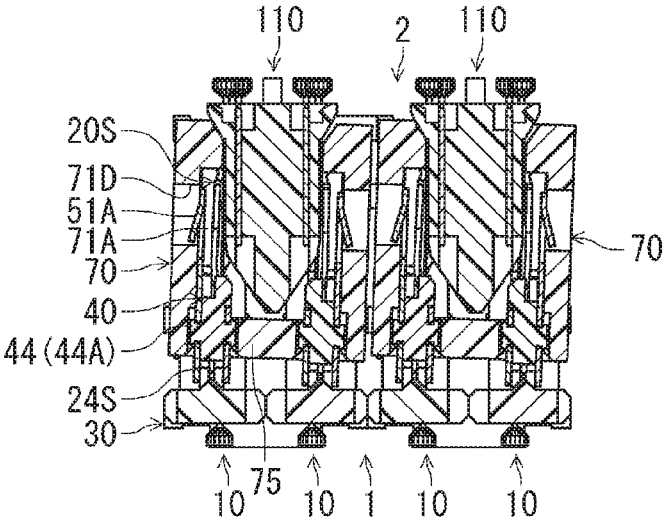
Figure 13:
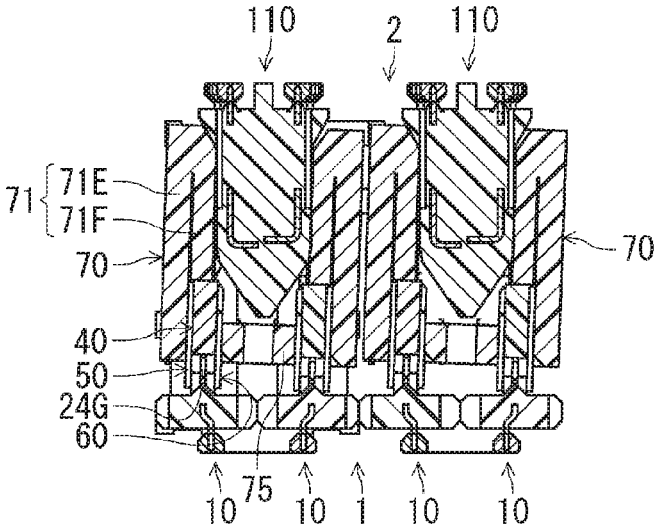

Furthermore, each casing body 70 has a middle wall 75 at the center in the terminal arrangement direction (see FIGS. 10, 12, and 13). Each middle wall extends in the connector's width direction (i.e., terminal arrangement direction) between the two facing end walls 72, and joins bottom parts of the end walls 72. Each middle wall 75 has thru holes 75A, which penetrate in the up-and-down direction, are arranged at a plurality of positions in the connector's width direction (see FIG. 10).

On inner surface of each side wall 71, there is formed an accommodating concave portion 71A to accommodate the receptacle-side connecting member 10 (see FIGS. 12(A) and 12(B)). As shown in FIG. 5(A), on an upper part of each side wall 71, there is formed and arranged a plurality of grooves 71B to accommodate the receptacle terminals 20. In addition, on an upper edge of the inner surface of each side wall 71, there are formed guiding surfaces 71C. The guiding surfaces 71C are sloped so that they are away from each other as they go upward in the facing direction of the side walls 71 (arrangement direction of the receptacle-side connecting members 10). As will be described later, the guiding surfaces 71C guide in the arrangement direction the fitting portions (fitting walls 122, which will be described later) of the plug connector 2 to the receiving portions 76, which will be described later.

In addition, in each side wall 71, there are formed attachment holes 71D to correspondingly receive the attachment portions 51A of the long covering flat portions 51 of the long grounding plates 50. The attachment holes 71D penetrate the side wall 71 in the wall thickness direction. As shown in FIG. 4(A), among the ends that form the attachment holes 71D, lower edges thereof are locked at the lower ends (free ends) of the attachment portions 51A. As a result, the receptacle-side connecting members 10 are prevented from coming off from the casing body 70. Moreover, as shown in FIG. 5(B), at the positions corresponding to the restricting surfaces 41A (see FIG. 5(A)) of the receptacle-side connecting members 10 in the connector's width direction, each side wall 71A has an outer wall 71E and an inner wall 71F, which are adjacent to each other in the wall thickness direction. The outer walls 71E and the inner walls 71F are joined at their upper ends. Lower ends of the inner walls 71F are provided above lower ends of the outer walls 71E. The lower end surfaces of the inner walls 71F (surfaces perpendicular to the up-and-down direction) abut the restricting surfaces 41A so as to form surfaces to be restricted 71F-1, which restrict downward movement of the casing bodies 70.

Figure 4:
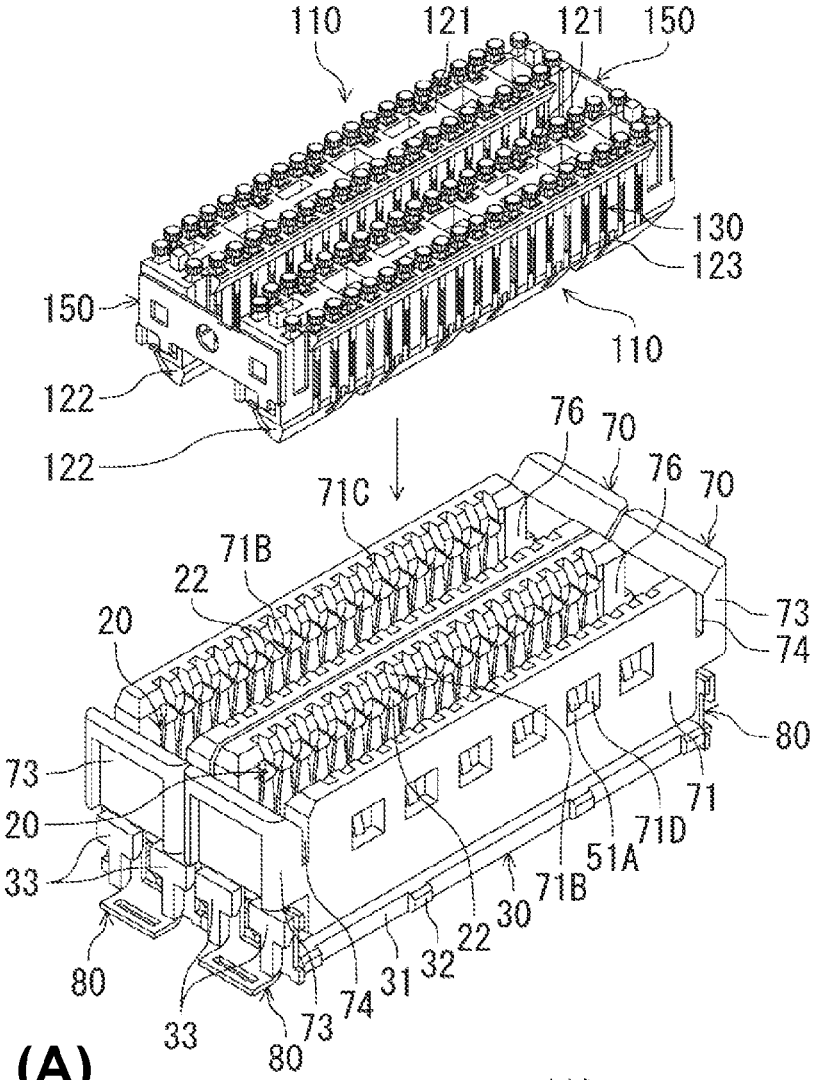
Figure 4:
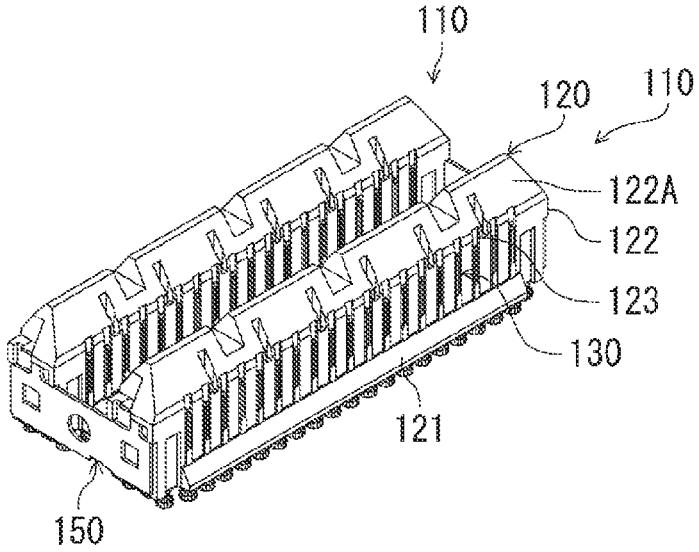

As shown in FIG. 4(A), the walls to be restricted 73 are joined at their lower parts to middle parts of the outer surfaces of the end walls 72 in the up-and-down direction. Each wall to be restricted 73 has a concave portion to be restricted 73A (see FIG. 12(A)), which is dented on inner surface (wall surface that faces outer surface of the end wall 72) thereof and is open downward. The concave portions to be restricted 73A are concave portions that extend perpendicularly to the connector's width direction. The concave portions to be restricted 73A receive the long flat portions 83 (which will be described later) of the receptacle-side joining members 80 from thereunder (see FIG. 12(A)). As will be described later, among the inner wall surfaces that form the concave portions to be restricted 73A, surfaces perpendicular to the arrangement direction of the receptacle-side connecting members 10 (left-and-right direction in FIG. 12(A)) can abut the side edges of the long flat portions 83. As a result, it is achievable to restrict angular displacement of the casing body 70, which exceeds a specified amount, around the connector's width direction (a direction perpendicular to the paper surface of FIG. 12(A)). Moreover, between the walls to be restricted 73 and the end walls 72, there are formed slits 74 in the arrangement direction (the longitudinal direction of the connector 1; see FIG. 4(A)). The slits 74 are open upward and receive the plug-side joining members 150 of the plug connector in the connector fitted state.

As well shown in FIGS. 1 and 2(A), each receptacle-side joining members 80 is made by die-cutting a sheet metal member that extends in the arrangement direction and bending in the sheet thickness direction. The receptacle-side joining members 80 are disposed at both sides of the receptacle-side connecting members 10 in the connector's width direction, with their sheet surfaces being perpendicular to the connector's width direction. The receptacle-side joining members 80 extend over the whole arrangement range of the receptacle-side connecting members 10 in the arrangement direction, and as will be described later, join and hold all the receptacle-side connecting members 10. According to the embodiment, the receptacle-side joining members 80 are made of metal having equivalent coefficient of thermal expansion to that of the circuit board, e.g., general copper alloy such as phosphor bronze.

Each receptacle-side joining member 80 includes a straight basal portion 81, short flat portions 82 and long flat portion 83, and soldering portions 84. The straight basal portions 81 extend straight over the whole arrangement range of the receptacle-side connecting members 10 in the arrangement direction. The short flat portions 82 and the long flat portions 83 rise from upper edges of each straight basal portion 81, and are alternately disposed at specified intervals in the arrangement direction of the connecting members 10. The soldering portions 84 extend outward in the connector's width direction from lower edge of each straight basal portions 81 at the same positions as those of the long flat portions 83 in the arrangement direction of the connecting members 10 (the longitudinal direction of the receptacle connector 1).

The short flat portions 82 are provided so as to correspond to positions between casing bodies that are adjacent to each other. The short flat portions 82 extend having substantially same height dimension as those of the walls to be held 33 of the stationary holding bodies 30. As shown in FIG. 2(B), each short flat portion 82 has a hole 82A, which is a through hole that extends in the up-and-down direction and penetrates in the sheet thickness direction. Each short flat portion 82 has short arms 82B provided on the both sides of the hole 82A.

In addition, the long flat portions 83 are provided so as to correspond to the positions of the respective casing bodies 70. As shown in FIG. 2(B), the long flat portions 83 are formed taller than the short flat portions 82 in the up-and-down direction, and slightly smaller than the concave portions to be restricted 73A of the walls to be restricted 73 of the casing bodies 70 in the arrangement direction of the connecting members 70 (see FIG. 5(B)). Each long flat portion 83 has a hole 83A, which extends in the up-and-down direction and penetrates in the sheet thickness direction. Each long flat portion 83 also has long arms 83B on the both sides of the hole 83A. Each of the both long arms 83B is chamfered on its upper end, such that each long flat portion 83 has a smaller width on its upper end.

As will be described later, the upper half portions of the long flat portions 83 are accommodated in the concave portions to be restricted 73A of the casing bodies 70 from therebelow (see FIG. 5(B)). As described above, the long flat portions 83 are slightly smaller than the concave portions to be restricted 73A in the arrangement direction. Therefore, there are gaps formed between the upper half portions of the long flat portions 83 and the inner wall surfaces of the concave portions to be restricted 73A in the arrangement direction. Moreover, since the outer edges of upper ends of the long arms 83B are chamfered, the casing bodies 70 can make angular displacement, having the connector's width direction as an axis of the displacement, i.e., displacement such that the casing bodies tilt in the arrangement direction (see FIG. 13(A) through 13(C)). In short, the upper half portions of the long flat portions 83 serve as restricting portions that restrict the above-described angular displacement of the casing bodies 70, when the displacements are greater than certain amount.

The soldering portions 84 are to be disposed and fixed to connect by soldering to corresponding parts on a mounting surface of the circuit board. As shown in FIG. 2(B), each soldering portion 84 has a securing hole 84A that penetrates therethrough in the sheet thickness direction (up-and-down direction in the figure)). Upon connecting by soldering, molten solder flows in the securing holes 84A and thereby it is achievable to enhance strength of securing the soldering portions 84 to the corresponding portions.

As shown in FIG. 2(B), between the short flat portions 82 and the long flat portions 83, there are provided grooves that extend in the up-and-down direction and open upward. The grooves are formed as holding grooves 85 and receive to hold the flat portions to be held 33A of the stationary holding bodies 30 of the receptacle-side connecting members 10 from above, when they are pressed therein.

[Assembling of the Receptacle Connector]

The receptacle connector 1 having the above-described configuration may be assembled as follows: Press the plurality of the receptacle-side connecting members 10 onto the two receptacle-side joining members 80 so as to be arranged and held therebetween. Then, attach each casing body 70 to a pair of the receptacle-side connecting members 10 that are adjacent to each other so as to accommodate them therein. Hereunder, how to assemble the receptacle connector 1 will be described in detail.

First, the receptacle-side connecting members 10 are prepared. More specifically, the lower portions to be held 23 of the receptacle terminals 20 arranged in the connector's width direction are integrally molded with the stationary holding body 30 so as to be held thereby. In addition, the upper portions to be held 25 of the receptacle terminals 20 are integrally molded with the movable holding portion 40 so as to be held thereby. Those integral molding steps may be performed in any order or performed at the same time. Thereafter, the holding protruding portions 44 on one surface of the movable holding body 40 are inserted in the holes 51B of the long grounding plates 50. Then, the holding protruding portions 44 are heated so as to flatten to widen the protruding ends of the holding protruding portions 44. As a result, the holding protruding portions 44 are thermally fused to the grounding plates 50 (see FIG. 8(C)). In addition, the holding protruding portions 44 on the other surface of the movable holding bodies 40 are inserted in the holes 61B of the short grounding plates 60. Then, similarly to the long grounding plates 50, the holding protruding portions 44 are thermally fused to the short grounding plates 60 (see FIG. 8(*c*)). As a result, each movable holding body 40 holds the grounding plates 50 and 60 and thereby the receptacle-side connecting member 10 is completed. According to the embodiment, the step of holding the long grounding plate 50 and the step of holding the short grounding plate may be done at the same time. Instead, either of the steps may be performed before the other step.

Next, orientating the casing body 70 by flipping upside down (so as to have the guiding surfaces 71 be on the lower side), the receptacle-side connecting members 10 are tentatively inserted in each of the two concave portions 71A of the casing body 70 from thereabove (from the side opposite the guiding surfaces 71C). At this point, the pair of the receptacle-side connecting members 10 to be tentatively inserted in the casing body 70 is tentatively inserted such that the convexly curved surfaces of the contact portions 22 of the receptacle terminals 20 face each other. The tentatively inserted receptacle-side connecting members 10 remain in a state only a part of the receptacle-side connecting member 10 is accommodated in the accommodating concave portions 71A.

Next, the receptacle-side joining members 80 are brought to the respective receptacle-side connecting members 10 from above, so as to have the holding grooves 85 of the receptacle-side joining members 80 tentatively hold the flat portions to be held 33A of the stationary holding bodies 30 in the receptacle-side connecting members 10. In the state of being tentatively held, the flat portions to be held 33A are not pressed in the holding grooves 85 yet, and remain in the state only a part of each flat portion to be held 33A entered in the holding groove 85.

Then, press the receptacle-side connecting members 10 and the receptacle-side joining members 80 therein at the same time from thereabove. At this point, being pressed onto the inner wall surfaces of the side walls 71 of each casing body 70, the attachment portions 51A of the long grounding plates 50 provided in the receptacle-side connecting members 10 elastically deform. Once the attachment holes 71D of the side walls 71 reach the positions of the attachment portions 51A, the attachment portions 51 return to their free state and enter the attachment holes 71D. As a result, the receptacle-side connecting members 10 are accommodated in the accommodating concave portions 71A of the casing bodies 70. At the same time, the lower ends of the attachment portions 51A and the lower edges of the attachment holes 71D become engageable, so that it is possible to prevent coming off from the casing bodies 70. Attachment of the receptacle-side connecting members 10 is completed by abutting of the surfaces to be restricted 71F-1 of the casing bodies 70 to the restricting surfaces 41A of the receptacle-side connecting members 10 (see FIG. 5(B)).

Moreover, once the receptacle-side joining members 80 are pressed in, the flat portions to be held 33A of the receptacle-side connecting members 10 are pressed in the holding holes 85 of the receptacle-side joining members 80 and held therein. According to the embodiment, each pair of the receptacle-side connecting members 10 is held in the holding grooves 85 provided on both sides of each long flat portion 83 of the receptacle-side joining members 80. In addition, the long flat portions 83 of the receptacle-side joining members 80 enter the concave portions to be restricted 73A of the walls to be restricted 73 of the casing bodies 70 from thereabove.

Figure 2:
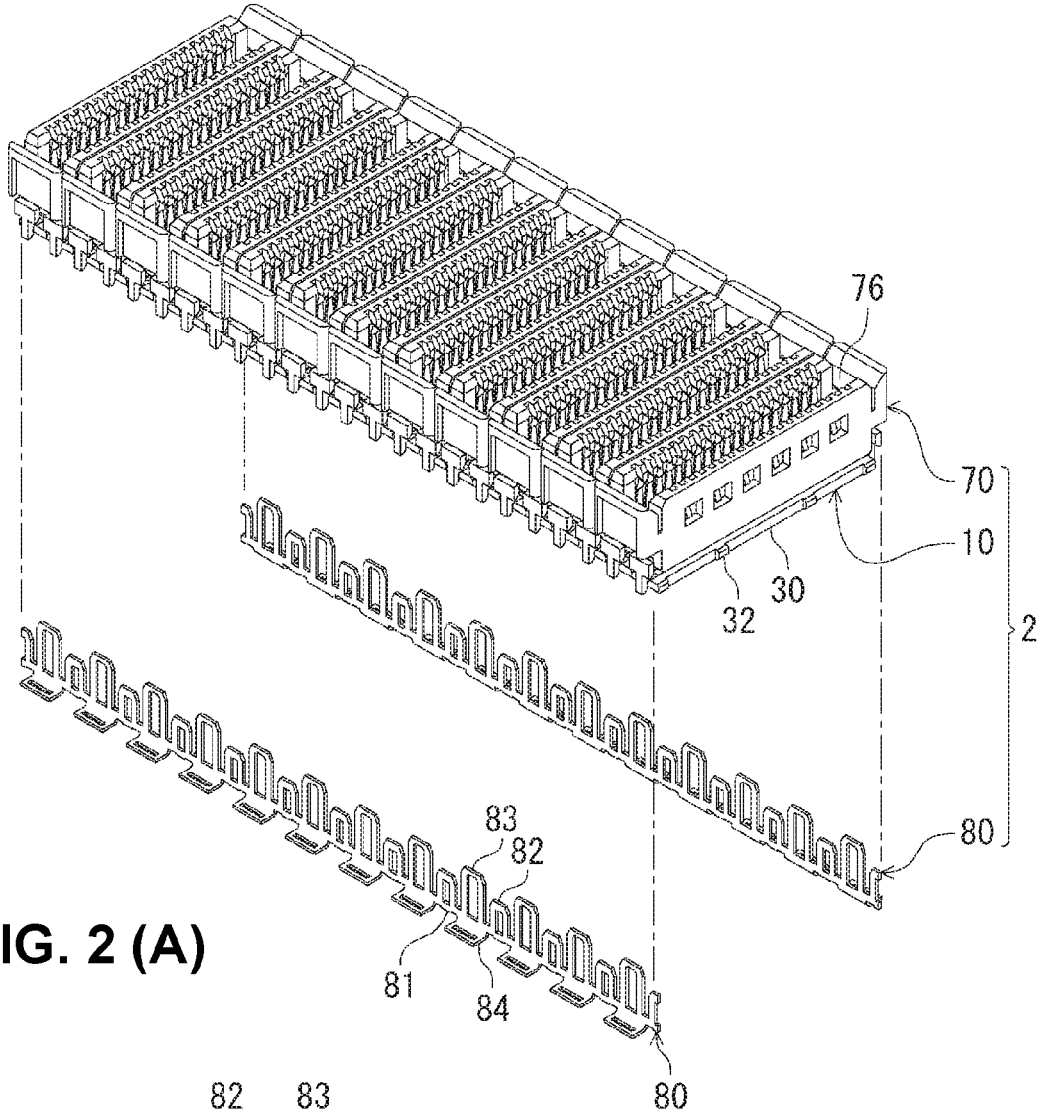
Figure 2:
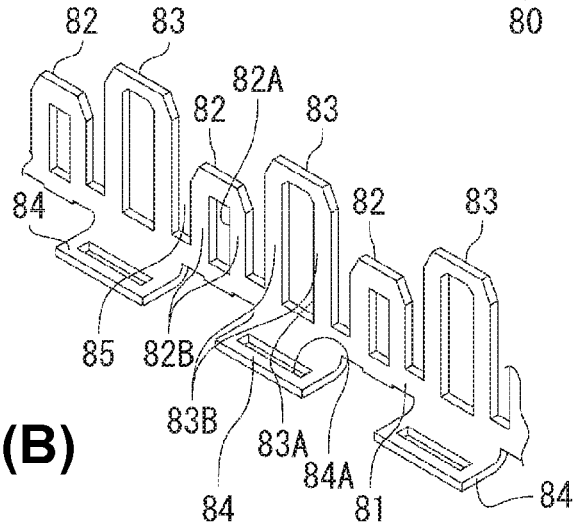

While being in the state that the attachment of the receptacle-side connecting members 10 and the receptacle-side joining members 80 to the casing bodies 70 is completed, the space formed between the two receptacle-side connecting members 10 in the casing bodies 70 are formed as receiving portions 76 to receive the fitting portions (fitting walls 122 that will be described later) of the connecting members 110 provided in the plug connector 2 (see FIGS. 1, 2, 4(A), etc.). Moreover, upper ends of the receptacle terminals 20 are accommodated in the grooves 71B of the casing bodies 70. In addition, the protruding top surfaces, i.e., pressure-receiving portions 44A, of the holding protruding portions 44 formed on the both side surfaces of the movable holding bodies 40 respectively get close to and face the inner surfaces of the side walls 71 or side walls of the middle walls 75 (see FIG. 12(B)). Moreover, in the concave portions to be restricted 73A of the walls to be restricted 73 of the casing bodies 70, a part of the long flat portions 83 of the joining members 80 (upper half parts in FIG. 5(B)) is accommodated. Accordingly, the receptacle-side connecting members 10 and the receptacle-side joining members 80 are attached to the casing bodies, and thereby assembling of the receptacle connector 1 is completed.

[Configuration of the Plug Connector 2]

Figure 3:
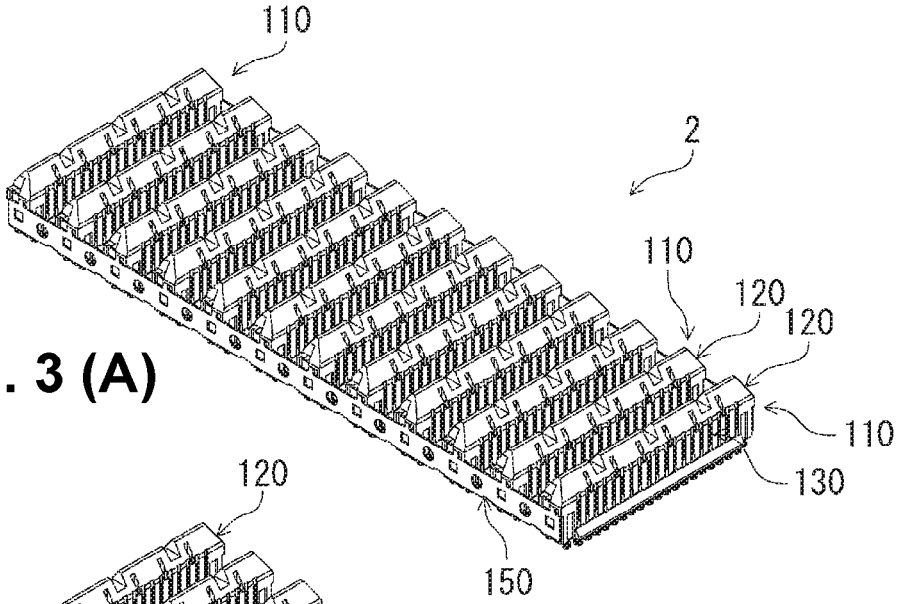
Figure 3:
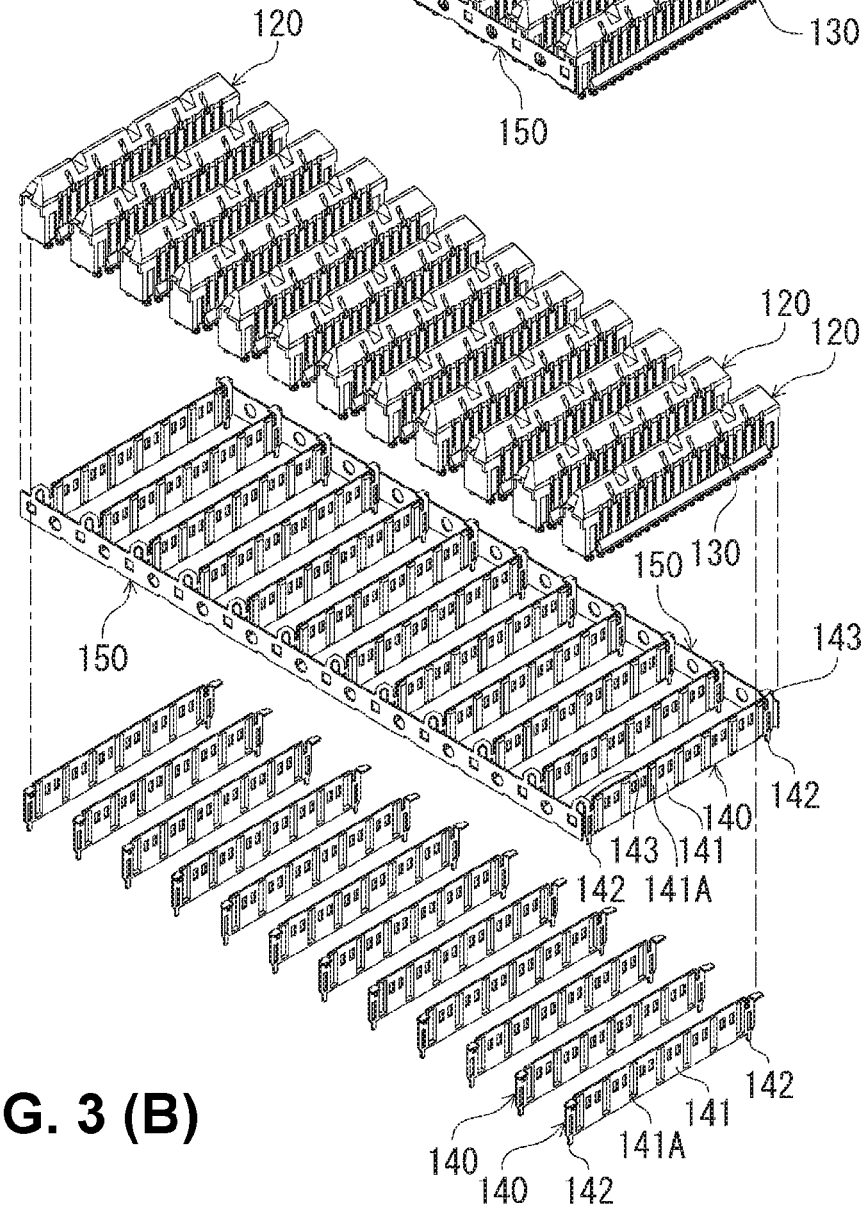

Next, a configuration of the plug connector 2 will be described. As shown in FIG. 3(A), the plug connector 2 includes a plurality of plug-side connecting members 110 and two plug-side joining members 150. The plurality of plug-side connecting members 110 is arranged in an arrangement direction, which is one direction horizontal to the mounting surface of the circuit board (not illustrated). The two plug-side connecting members 150 extend in the arrangement direction over the arrangement range of the plurality of plug-side connecting members 110, and join and hold the plurality of connecting members 110. According to the embodiment, as shown in FIG. 3(A), the plurality of plug-side connecting members 110 is arranged so as to form gaps between adjacent plug-side connecting members 110 (see also FIG. 11(A) through 11(C)). The dimension of each gap is set greater than the thermal expansion of the plug-side connecting members 110.

As shown in FIG. 3(A), each of the plug-side connecting members 110 includes a housing 120, a plurality of plug terminals 130, and two grounding plates 140. The housing 120 extends, having the connector's width direction (the same direction as the connector's width direction of the receptacle connector 1) as a longitudinal direction thereof. The housing 120 serves as a terminal holding member made of an electrically insulating material. The plurality of plug terminals 130 is arranged in the connector's width direction and held by the housing 120. The two grounding plates 140 are held in each housing 120 (see FIG. 3(B)).

As is well shown in FIG. 4(A), each of the housings 120 extends in the connector's width direction as a longitudinal direction thereof, and is formed to have substantially the same dimension as that of the receptacle connector 1 in the direction. As well shown in FIG. 4(B), each of the housings 120 has a basal portion 121, which forms a lower part of the housing 120, and a fitting wall 122, which rises upward from the basal portion 121. The fitting walls 122 are formed as fitting portions to fit to the receiving portions 76 of the receptacle connector 1. As shown in FIG. 4(B), an upper part of each fitting wall 122 has a slanted surface, which is sloped such that the both side surfaces get close to each other as it goes upward and has a tapered shape when viewed in the connector's width direction. The slanted surfaces are formed as surfaces to be guided 122A, which are guided by the guiding surfaces 71C of the receptacle-side connecting members 10 in the connector fitting step.

Figure 11:
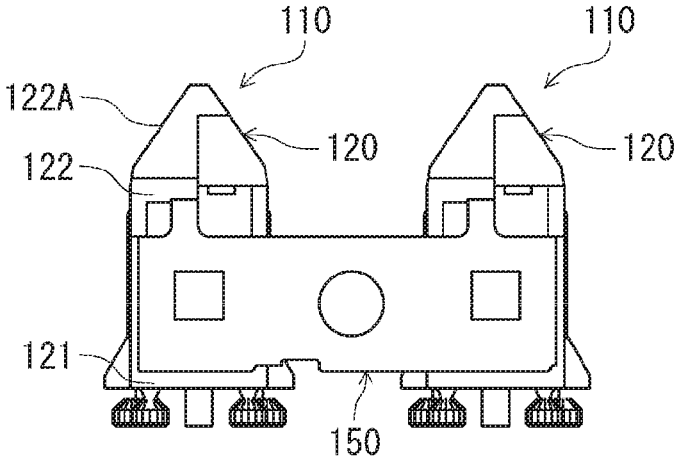
Figure 11:
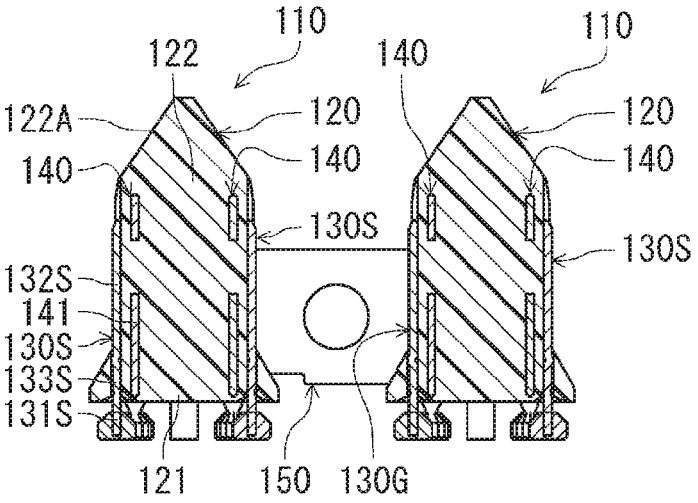
Figure 11:
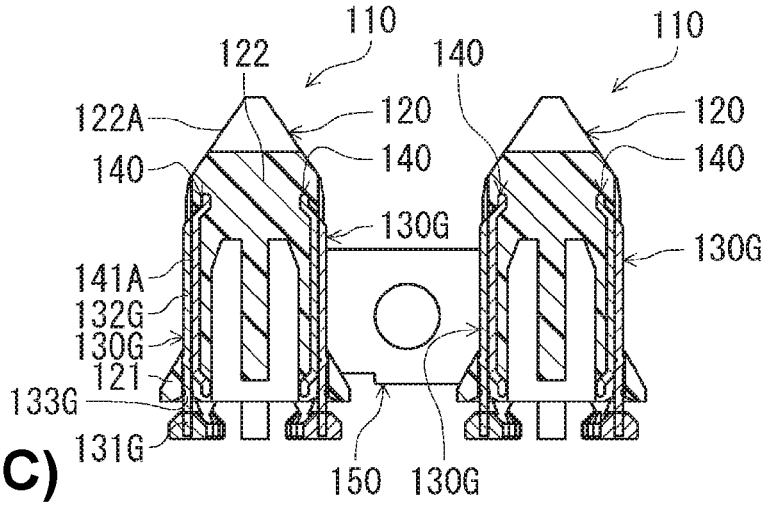

Moreover, each of the housings 120 includes a plurality of terminal accommodating portions 123, which extend in the up-and-down direction. The plurality of terminal accommodating portions 123 is arranged at equal intervals in the connector's width direction. The plurality of terminal accommodating portions 123 accommodates and holds the plug terminals 130. As shown in FIGS. 11(B) and 11(C), in the range of each fitting wall 122, the terminal accommodating portions 123 are formed as grooves extending in the up-and-down direction on the both side surfaces (surfaces perpendicular to the arrangement direction of the plug-side connecting members 110) of each fitting wall 122, which extends in the connector's width direction. In the range of each basal portion 121 the terminal accommodating portions 123 are formed in the up-and-down direction as holes that connect to the grooves and penetrate the basal portions 121. In addition, each terminal accommodating portion 123 to accommodate a grounding terminal 130G, which will be described later, has on its groove bottom (inner wall surface perpendicular to the arrangement direction) an opening that is opened inward in the arrangement direction. From the openings, contact portions 132G of the grounding terminals 130 are exposed. As a result, as will be described later, the grounding contact portions 141 of the grounding plates 140 can contact with the contact portions 132 of the grounding terminals 130G (see FIG. 11(B)).

Each plug terminal 130 is made by die-cutting a sheet metal member in its sheet thickness direction, and has a strip-like shape extending straight in the up-and-down direction as a whole. The plug terminals 130 are pressed in the terminal accommodating portions 123 of the housing 120 from therebelow with their sheet surfaces being perpendicular to the arrangement direction and held therein, so as to be arranged in the connector's width direction. The plurality of plug terminals 130 serve as signal terminals 130S or the grounding terminals 130G. According to the embodiment, the signal terminals 130 and the grounding terminals 130G are arranged corresponding to the arrangement of the signal terminals 20S and the grounding terminals 20G. More specifically, the plug terminals 130 are arranged so as to have two signal terminals 130S, which are adjacent to each other, between the grounding terminals 130G. Hereunder, when there is no need to specify if the terminal 130 is the signal terminal 130S or the grounding terminal 130G, the configuration will be described simply using the term, "plug terminal 130". Moreover, when it is necessary to specify if the terminal 130 is the signal terminal 130S or the grounding terminal 130G, "S" will be affixed to the reference numeral of each portion of the signal terminal 130S, and "G" will be affixed after reference numeral of each part of the grounding terminal 130G.

As well shown in FIGS. 11(B) and 11(C), the plug terminals 130 are provided on the both side surfaces of each fitting wall 122 of the housing 120. The plug terminals 130 are provided to form two rows that are symmetrical about the fitting wall 122 in the wall thickness direction of the fitting wall 122 (the arrangement direction of the plug-side connecting members 110). As shown in FIGS. 11(B) and 11(C), the plug terminals 130 have at their lower ends (one ends) the connecting portions 131 to be connected by soldering to the circuit portion of the mounting surface of the circuit board. The plug terminals 130 have at their upper ends (the other ends), contact portions 132 to contact with the receptacle terminals 20 provided on the receptacle connector 1. The connecting portions 131 and the contact portions 132 are joined by portions to be held 133. As shown in FIGS. 11(B) and 11(C), contact portions 132 extend in the up-and-down direction within the grooves of the terminal accommodating portions 123. Sheet surfaces of the contact portions 132 are exposed from the side surfaces of each fitting wall 122.

Each grounding plate 140 is made by presswork and bending of a sheet metal member. As shown in FIG. 3(B), each grounding plate 140 has a grounding main body 141 and grounding legs 145. The grounding main body 141 has a sheet surface perpendicular to the arrangement direction of the plug-side connecting members 110 and extends generally the whole range of the plug-side connecting member 110 in the connector's width direction. The grounding legs 142 are provided on the both ends of each grounding main body 141 in the connector's width direction so as to extend from a lower edge thereof. Moreover, in the two grounding plates 140, each of one grounding plates 140 also has joining portions 143, which will be described later. With those joining portions 143, the grounding main body 141 is joined to the plug-side joining members 150, which will be described later. In other words, the one grounding plates 140 and the plug-side joining member 150 are integrally formed as one member. According to the embodiment, the grounding plates 140 and the plug-side joining members 150 are made of metal that has similar coefficient of thermal expansion to that of the circuit board, for example, general copper alloy such as phosphor bronze.

As shown in FIGS. 11(B) and 11(C), each grounding main body 141 extends inside the fitting wall 122 of each housing 120, in short, between the terminal rows of the plug terminals 130, in the connector's width direction (a direction perpendicular to the paper surface of FIGS. 11(B) and 11(C)). In other words, each grounding main body 141 is provided on the side opposite the contact surfaces of the contact portions 132 in the two sheet surfaces of the plug terminals 130. Furthermore, as shown in FIGS. 11(B) and 11(C), each grounding main body 141 is provided in the range that corresponds to the contact portions 132 of the plug terminals 130 in the up-and-down direction.

As shown in FIG. 11(C), each grounding main body 141 has a grounding contact portion 141A, which protrudes towards the grounding terminals 130G and extends in the up-and-down direction (see also FIG. 3(B)). The grounding contact portions 141A are made by presswork. As shown in FIG. 11(C), the grounding contact portions 141A contacts with sheet surfaces of the contact portions 132G of the grounding terminals 130G at their protruding top surfaces (flat surfaces).

According to the embodiment, as shown in FIGS. 3(B) and 11(C), the two grounding plates 140 are provided symmetrically so as to have their grounding contact portions 141A protrude being opposite each other in the arrangement direction. The grounding plates are held in the housing 120 by integral molding.

The grounding legs 142 are to be connected to corresponding grounding circuit portion (not illustrated) of the circuit board at their ends.

In addition, the grounding plates 140 joined to the plug-side joining members 150 have joining portions 143 on the both ends of the g main bodies 141. The joining portions 143 join the plug-side joining members 150 and the grounding main bodies 141. As shown in FIG. 3(B), the joining portions 143, when viewed from thereabove, extend in generally L-shapes having sheet surfaces perpendicular to the up-and-down direction. The joining portions 143 join an upper edge of each grounding main body 141 to upper edges of the plug-side joining members 150.

As shown in FIG. 3(A), the plug-side joining members 150 are oriented having their sheet surfaces be perpendicular to the connector's width direction. The plug-side joining members 150 are provided on the both ends of the plug-side connecting members 110 in the connector's width direction. The plug-side joining members 150 extend over the whole arrangement range of the plug-side connecting members 110 in the arrangement direction. As already described above, the plug-side joining members 150 are joined to the grounding plates 140 provided on the respective plug-side connecting members via the joining portions 143.

According to the embodiment, the grounding plates 140 are electrically connected via the plug-side joining members 150. Therefore, it is achievable to enhance the grounding effect. Furthermore, the plug-side joining members 150 cover with their sheet surfaces end surfaces of the plug-side connecting members 110 (surfaces perpendicular to the connector's width direction). Therefore, the plug-side joining members 150 is also capable of serving as shielding plates.

In addition, according to the embodiment, grounding plates 140 and the plug-side joining members 150 are integrally made of the same sheet metal members. However, it may not be necessary to make them from the same members. Alternatively, the grounding plates 140 and the plug-side joining members 150 may be separately made as different members.

[Assembling of the Plug Connector 2] The plug connector 2 having the above-described configuration may be prepared as follows. First, while having sheet surfaces of the grounding main bodies 141 of two grounding plates 140 face each other in the arrangement direction, the grounding main bodies 141 are integrally molded to be held by the housing 120. Upon performing the integral molding, in the grounding plates 140 joined to the plug-side joining members 150, the joining parts between the joining portions 143 and the plug-side joining members 150 are not bent. The sheet surfaces of the plug-side joining members 150 are perpendicular to the up-and-down direction.

Next, the joining parts between the joining portions 143 and the plug-side joining members 150 are bent at a right angle in the sheet thickness direction so as to have the plug-side joining members 150 be close and face the end surface of the housing 120 (see FIG. 3(A)). Then, pressing the plug terminals 130 into the terminal accommodating portions 123 of the housing 120 from therebelow to be held therein, the plug connector 2 is completed.

[Mounting of the Connectors 1 and 2 onto the Circuit Board]

Next, mounting of the receptacle connector 1 and the plug connector 2 onto the circuit board will be described. The connecting portions 21 of the receptacle terminals 20, which are provided on all the receptacle-side connecting members 10, are connected to corresponding circuit portions of the circuit board by soldering. The soldering portions 84 of the receptacle-side joining members 80 are corresponding portions of the circuit board. As a result, the receptacle connector 1 is mounted on the circuit board by soldering.

The receptacle connector 1 may be mounted on the circuit board by soldering, for example by reflow soldering with the circuit board while the receptacle connector 1 is disposed on the mounting surface of the circuit board. Upon the mounting by soldering, the receptacle-side connecting members (especially the stationary holding bodies 30 and the movable holding bodies 40), the receptacle-side joining members 80, and the circuit board are respectively thermally expanded. According to the embodiment, the receptacle-side joining members 80 are made of metal having the same coefficients of thermal expansion as that of the circuit board. There is hardly any difference in the coefficients of thermal expansion between them. Therefore, the thermal expansions of them are substantially the same. Therefore, in the parts of the receptacle-side connecting members 10, which are held by the receptacle-side joining members 80, to be mounted onto the coefficients of thermal expansion, there is no residual stress due to the difference in the coefficients of thermal expansion, or hardly any residual stress.

Moreover, in the receptacle connector 1, the plurality of receptacle-side connecting members 10 are joined and held with the receptacle-side joining members 80. Therefore, upon mounting by soldering, the terminal holding members (the stationary holding bodies 30 and the movable holding bodies 40) themselves of the plurality of receptacle-side connecting members 10 respectively thermally expand in small amount. More specifically, as a whole connector, the terminal holding members (30 and 40) deform in the arrangement direction, such that the deformation is dispersed over the whole range of the receptacle-side connecting members in the arrangement direction. Therefore, the connecting members will not deform with a large amount of thermal expansion as in conventional connector, in which a plurality of terminals is held only by one housing. As a result, it is achievable to satisfactorily secure the state of the receptacle terminals 20 being mounted on the circuit portions of the circuit board by soldering.

As described above, the stationary holding bodies 30 are formed such that the protruding portions 32 to restrict positions in the arrangement direction protrude towards the arrangement direction from side surfaces of the holding portions 31. The stationary holding bodies 30 are made upon integral molding with the receptacle terminals 20. Upon the integral molding, once melted electrically insulating material (e.g., resin material) is poured in a molding die, the electrically insulating material flows in the arrangement direction inside the die corresponding to the protruding portions 32. Generally speaking, it is known that electrically insulating materials such as glass fiber-containing resin (LCP, etc.) for use in connectors have very small coefficients of thermal expansion in a direction along the flow of the molten material in comparison with those in a direction perpendicular to the flow. Therefore, the protruding portions 32, which are made of electrically insulating material flown in the arrangement direction, have small coefficients of thermal expansion in the arrangement direction, which is a direction along the flow. In addition, the protruding portions 32 have smaller coefficients of thermal expansion than those of the receptacle-side joining members 80. Accordingly, upon the mounting by soldering, the thermal expansion of the protruding portions 32 in the arrangement direction is small. As a result, it is achievable to restrain as much as possible the influence of the thermal expansion of the protruding portions 32 that contact each other on the deformation of the whole receptacle connector 1 in the arrangement direction.

Furthermore, according to the embodiment, there is the plurality of protruding portions 32 provided on each of the both side surfaces of the receptacle-side connecting members 10. The protruding portions 32 are provided at different positions between those side surfaces in a middle range (range except the both ends) in the connector's width direction, when viewed in the arrangement direction. Accordingly, since the protruding portions 32 are provided at different positions between the side surfaces from each other. Upon the mounting by soldering, it is achievable to avoid transmission of abutting force (external force) from the adjacent receptacle-side connecting member 10 to the receptacle-side connecting member that abuts on the other side by thermal expansion in the arrangement direction. For example, when the protruding portions 32 on one side surface receive abutting force from the protruding portions 32 of the receptacle-side connecting members 10 that are adjacent on the other side surface, there is no protruding portion at positions corresponding to the protruding portions 32 on the one side surface, which receives the abutting force, on the other surface of the receptacle-side connecting member 10. Accordingly, the abutting force will not transmitted to the receptacle-side connecting member that is adjacent on the other side surface, and is dispersed with a component along the other surface. As a result, it is achievable to further reduce the external force (abutting force) exerted on the receptacle-side connecting members 10 in the arrangement direction, and in turn the residual stress in the parts being mounted by soldering.

In this embodiment, it is not essentially required to have the protruding portions 32 on one side surface and the protruding portions 32 on the other side surface of each receptacle-side connecting member be provided on different positions when viewed in the according to the embodiment. As long as it is achievable to sufficiently reduce the residual stress that occurs in the part mounted by soldering, all the protruding portions 32 may be provided at the same positions.

The plug connector 2 may be mounted on the circuit board by soldering, by respectively connecting the connecting portions 131 of the plug terminals 130 provided on the all the plug-side connecting members 110 and the grounding legs 142 of the grounding plates 140 onto corresponding circuit portions of the circuit board by soldering.

For mounting the plug connector 2 by soldering, similarly to the receptacle connector 1, while disposing the plug connector 2 on a mounting surface of the circuit board, the plug connector 2 is mounted by reflow soldering with the circuit board. Moreover, according to the embodiment, the plug-side joining members 150 are made of metal having the same coefficient of thermal expansion as that of the circuit board. Therefore, there is hardly difference in the coefficient of thermal expansion between the plug-side joining members 150 and the circuit board, so that the thermal expansions are substantially the same between them. Therefore, on the parts to be mounted of the plug connecting members 110, which are held by the plug-side joining members 150, onto the circuit board, there is no residual stress or hardly any residual stress occurred due to the coefficients of thermal expansion.

In addition, the plug connector 2 includes the plurality of plug-side connecting members 110, which are joined and held with the plug-side joining members 150. Therefore, similarly to the above-described receptacle connector 1, when the whole connector is viewed, the housing 120 deforms in the arrangement direction with the deformation spreading over the whole area in the arrangement direction of the receptacle-side connecting members 10. As a result, it is achievable to satisfactorily secure the mounted state by soldering between the plug terminals 130 and the circuit board.

Moreover, according to the embodiment, adjacent plug-side connecting members 110 are arranged with spaces therebetween greater than the amount of thermal expansion of the plug-side connecting members 110 in the arrangement direction of the plug-side connecting members 110 by mounting onto the circuit board. Accordingly, upon mounting by soldering, the respective plug-side connecting members 110 are in the thermally expanded state within the range of the gaps in the arrangement direction. Therefore, adjacent plug-side connecting members 110 will not abut each other. As a result, when the whole connector is viewed, it is achievable to prevent warping or twisting of the connector 2 due to abutting between the connecting members, and to more securely prevent occurrence of the residual stress at the mounted parts by soldering.

According to the embodiment, the joining members 80 and 150 are made of metals having similar coefficients of thermal expansion to each other. Alternatively, for example, the joining members 80 and 150 can be also made of resin having similar coefficient of thermal expansion to that of the circuit board. Even in case of making the joining members 80 and 150 from such resin, the thermal expansion of the joining members 80 and 150 and the thermal expansion of the circuit board are substantially the same. It is achievable to minimize generation of the residual stress at the mounted parts of the connecting members 10 and 110 onto the circuit board due to the difference in the coefficients of thermal expansion. The resin having similar coefficient of thermal expansion to that of the circuit board may include polyamide resin such as 9T Nylon manufactured by Kuraray.

[Fitting of Connectors]

Next, operation of fitting the receptacle connector 1 and the plug connector 2, which are respectively mounted on the circuit boards, will be described. First, as shown in FIGS. 1, 4(A), and 12(A), directing the receiving portion 76 of the receptacle connector 1 so as to open upward and the fitting walls 122 (fitting portions) of the plug connector 2 so as to extend downward from the basal portion 121, the plug connector 2 is brought above the receptacle connector 1. Then, the fitting walls 122 of the respective plug-side connecting members 110 are positioned corresponding to the receiving portions of the casing bodies 70.

Next, the plug connector 2 is moved downward and the respective plug-side connecting members 110 are fitted to the respective corresponding receptacle-side connecting members 10 from above. At this point, the fitting walls 122 of the respective plug-side connecting members 110 elastically deform the receptacle terminals 20 of the two re-side connecting members 10, which face each other in the arrangement direction, so as to be away from each other, i.e., to widen between the receptacle terminals 20, and then enter the receiving portions 76. On the other hand, the plug-side joining members 150 of the plug connector 2 enter the slits 74 of the respective casing bodies 70.

As shown in FIG. 12(B), once the receptacle-side connecting members 10 and the plug-side connecting members 110 fit to each other, the contact portions 22 of the receptacle terminals 20 and the contact portions 132 of the plug terminals 130 contact each other with certain contact pressure. As a result, the contact portions 22 and the contact portions 132 are electrically connected to each other. More specifically, the contact portions 22S of the signal terminals 20S contact with the contact portions 132S of the signal terminals 130S (see FIG. 12(B)). The contact portions 32G of the grounding terminals 20G contact the contact portions 132G of the grounding terminals 130G. As a result, all the receptacle-side connecting members 10 and plug-side connecting members 110 fit to each other, and thereby the fitting between the receptacle connector 1 and the plug connector 2 is completed.

Next, an operation of fitting the connectors 1 and 2 will be explained when relative positions of the receptacle connector 1 and the plug connector 2 are not aligned in the arrangement direction of the connecting members 10 and 11. When the relative positions of the connectors 1 and 2 are not aligned in the arrangement direction right before fitting the connectors 1 and 2, right after starting the fitting of the connectors 1 and 2, first, the surfaces to be guided 122A of the fitting walls 122 of the plug-side connecting members 110 abut against the guiding surfaces 71C of the casing bodies 70 of the receptacle connector 1. Furthermore, when the plug connector 2 is moved downward, the casing bodies 70 receive pressing force, which directs toward the side where the plug-side connecting members 110 are not aligned in the arrangement direction, from the surfaces to be guided 122A of the plug-side connecting members 110. As a result, the casing bodies 70 make angular displacement relative to the stationary holding bodies 30, so as to tilt towards the side where the plug-side connecting members 110 are misaligned, with the connector's width direction being a rotational axis.

Once the casing bodies 70 make angular displacement, in the two receptacle-side connecting members 10 in the casing body 70, the pressure-receiving portions 44A of the movable holding bodies 40 receive pressing force from the side walls 71 or middle wall 75 of the respective casing bodies 70. At the same time, the movable holding bodies 40 receive pressing force via the long grounding plates 50 from the outer walls 71E of the side walls 71 or via the short grounding plates 60 from the middle wall 75 (see FIG. 13(C)).

According to the embodiment, as described above, the terminal row of the receptacle terminals 10 (the row of the receptacle terminals 10 arranged in the connector's width direction in each receptacle-side connecting member 10) and each movable holding body 40 to hold the terminal row can displace in the arrangement direction, independently among each receptacle-side connecting members 10. Therefore, when the pressure-receiving portions 44A of the movable holding bodies 40 receive pressing force, the movable holding bodies 40 do not displace straight in the displacement direction, but as shown in FIG. 13(A) through 14(C), make angular displacement relative to the stationary holding bodies 30 with the casing bodies 70.

As a result, with the angular displacement of the movable holding bodies 40, as shown in FIG. 13(B), the deformable portions 24 of the receptacle terminals 20 held by the movable holding bodies 40 deform to be bent in the sheet thickness direction. Accordingly, the receptacle terminals 20 displace such that parts from the deformable portions 24 to upper ends (ends of the contact portions 22) tilt with the deformable portions 24 being fulcrum. The deformation of the deformable portions 24 may be either elastic deformation or plastic deformation. As described above, the casing bodies 70 make angular displacement and thereby the receptacle-side connecting members 10 displace in a direction of the displacement in the relative positions. As a result, following the displacements, the receptacle connector 1 floats.

According to the embodiment, the receptacle terminals 20 displace to tilt. Therefore the amount of displacement of the contact portions 22 of the receptacle terminals 20 in the direction of the displacement is greater than when the contact portions of the terminals displace straight in the displacement direction without tilting as in conventional connector. In other words, according to the embodiment, it is not necessary to increase the whole length of the terminals and in turn the side of the connector. In addition, it is also not necessary to complicate the shapes of the terminals, to achieve large floating and thereby it is achievable to manage great positional displacement between the connectors.

Furthermore, according to the embodiment, the deformable portions 24 are located between the lower portions to be held 23 and the upper holding portions 25. In short, the deformable portions 24 are positioned between the stationary holding bodies 30 and the movable holding bodies 40. Therefore, the receptacle terminals 20 will not be flexed at the lower portions to be held 23, which are held by the stationary holding bodies 30 and at the upper holding portions 25, which are held by the movable holding bodies 40. As a result, it is achievable to bend to deform the deformable portions 24 by securely focusing the stress on the deformable portions 24 upon floating.

As a result of the floating of the receptacle connector 1 as described above, the guide surfaces 71C of the casing bodies 70 guide the fitting walls 22 of the plug-side connecting members 110 into the receiving portions 76. The contact portions 132 of the plug terminals 130 are brought to the positions to be contactable with the contact portions 22 of the receptacle terminals 20. Then, the plug-side connecting members being moved further downward, the connector fitting operation is completed. As shown in FIG. 13(A) through 13(C), even in the state that the connector fitting operation is completed, the tilted state of the casing bodies 70 and the receptacle-side connecting members 10 is maintained.

According to the embodiment, the receptacle connector 1 floats in the connector fitting step, but it may not be only the connector fitting step for the receptacle connector 1 to float. For example, even when the connectors 1 and 2 are fitted to each other at regular fitting positions, while the connectors 1 and 2 are being the fitted state, the connectors 1 and 2 may receive unexpected external force in the arrangement direction. Even when the relative positions between the connectors 1 and 2 are displaced in the connector fitted state, it is achievable to satisfactorily keep the electrically connected state between the connectors 1 and 2 by floating the receptacle connector 1 in the direction of the displacement.

According to the embodiment, the contact portions 22 of the receptacle terminals 20 are made wider than those of the contact portions 132 of the plug terminals 130. Therefore, in the connector fitting step and in the connector fitted state, even when the relative positions between the receptacle terminals 20 and the plug terminals 130 are not aligned, it is achievable to contact the contact portions 22 and 132 to each other as long as the contact portions 132 of the plug terminals 130 are within the range of the widths of the contact portions 22 of the receptacle terminals 20. According to the embodiment, the contact portions 22 of the receptacle terminals 22 are made wide. Alternatively, the contact portions 132 of the plug terminals 130 may be made wide. In addition, the contact portions 22 and 132 of the both terminals 20 and 130 can be made wide.

Moreover, according to the embodiment, the angularly displaced casing bodies 70 press the pressure-receiving portions 44A of the movable holding bodies 40 of the receptacle-side connecting members 10 and thereby the receptacle-side terminals 20 are displaced. In other words, the casing bodies 70 indirectly push the receptacle terminals 20 via the movable holding bodies 40. Instead, the casing bodies 70 can directly push the receptacle terminals 20 to displace.

According to the embodiment, depending on the displacement in relative positions between the connectors 1 and 2, the casing bodies 70 make angular displacement. Alternatively, for example, the casing bodies 70 can displace straight in the arrangement direction, or can displace so as to include both angular displacement and straight displacement.

According to the embodiment, the receptacle terminals 20 displace in the sheet thickness direction and also contact with the plug terminals 130 at their sheet surfaces. Instead, the receptacle terminals 20 can displace in a direction horizontal to the sheet surfaces, and contact with the plug terminals 130 at their sheet thickness surfaces (die-cut surfaces).

In addition, according to the embodiment, while the contact portions 22 of the receptacle terminals 20 are convexly curved and have elasticity, the contact portions 132 of the plug terminals 130 do not have elasticity. Alternatively, the contact portions 132 of the plug terminals 130 can have elasticity as well as or instead of the contact portions 22 of the receptacle terminals 20. Moreover, according to the embodiment, the receptacle terminals 20 can deform at the deformable portions 24. Therefore, it is not essential for the contact portions 22 of the receptacle terminals 20 to have elasticity. Even if the contact portions 22 do not have elasticity, the contact portions 22 can still contact with the contact portions 132 of the plug terminals 130 with certain contact pressure.

According to the embodiment, the invention is applied in a connector assembled component, in which a connector fitting direction is set as a direction perpendicular to a mounting surface of a circuit board. Alternatively, for example, the invention may be applicable to a so-called right angle-type connector assembled component, in which a fitting direction is set as a direction horizontal to a mounting surface of a circuit board.

Second Embodiment

Figure 14:
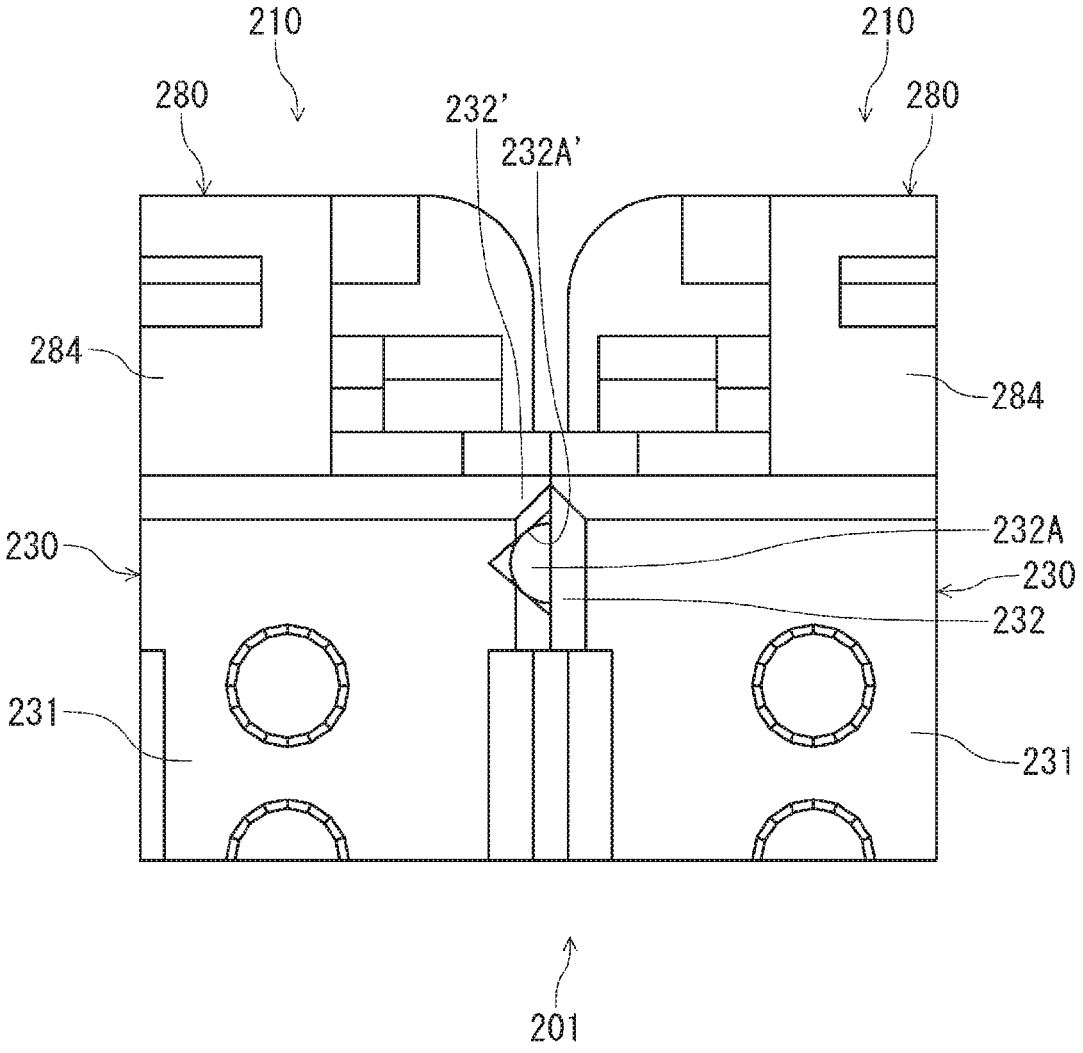
FIG. 14 is a bottom view showing a part of the receptacle connector according to a second embodiment, which shows an enlarged view around a pair of protruding portions that contact each other.

According to the first embodiment, in the receptacle connector 1, the protruding portions 32 of the receptacle-side connecting members 10 that are paired and are able to abut each other are made to have the same shape. On the other hand, according to the second embodiment, the protruding portions that are able to abut each other have different shapes from each other, which is a difference from the first embodiment. FIG. 14 is a bottom view showing a partially enlarged receptacle connector 1 of the second embodiment, which include the protruding portions that are able to abut each other. In FIG. 14, parts that correspond to the respective parts of the receptacle connector 1 in the first embodiment are indicated with reference numerals in the first embodiment but "200" are added.

According to the embodiment, on each protruding portion 232 on one side surface of each receptacle-side connecting member 21, there is formed a convex abutting portion 232A, which will be described later. On each protruding portion 232' on the other side surface, there is formed a concave abutting portion 232A', which will be described later. Each protruding portion 232 has a shape, in which the convex abutting portion 232A, which is shaped like a semicircular column, from the protruding top surface of the protruding portion 32 in the first embodiment. The convex abutting portions 232A have semicircular shapes and extend in the up-and-down direction when viewed in the up-and-down direction (a direction perpendicular to the paper surface of FIG. 14). On the other hand, each of the protruding portions 232', which is able to abut the protruding portions 232, has a shape of the protruding portion 32 in the first embodiment, but further includes a V-shaped concave abutting portions 232A' on the protruding top surface of the protruding portion 32. The concave abutting portions 232A' have V-shapes when viewed in the up-and-down direction, and extend in the up-and-down direction when viewed in the up-and-down direction.

In the protruding portions 232 and the protruding portions 232', which are paired facing each other between adjacent receptacle-side connecting members 210, as shown in FIG. 14, the convex abutting portions 232A enter the concave abutting portions 232A'. Then, the convex curved surfaces of the convex abutting portions 232A abut inner groove surfaces of the concave abutting surfaces 232A', i.e., surfaces tilted relative to the arrangement direction of the receptacle-side connecting members 210.

As described above, the protruding portions 232 and the protruding portions 232' are able to abut each other with their sloped surfaces. Therefore, upon mounting by soldering, even when the receptacle-side connecting members 210 thermally expand in the arrangement direction and the convex abutting portions 232A and the concave abutting portions 232' abut each other, such abutting force will be dispersed also in the connector's width direction (in the u in FIG. 14). Accordingly, it is achievable to reduce the abutting force (external force) that works on the receptacle-side connecting members in the arrangement direction. As described above, if it is achievable to disperse the abutting force, for example even when all the protruding portions are provided at the same positions in the connector's width direction, it is achievable to securely reduce the stress on the parts to mount by soldering.

In addition, the shapes of the protruding portions that abut each other may not be limited to the one in FIG. 14. The shapes of the protruding portions can be any as long as one protruding portion in a pair of protruding portions, which abut each other, abuts the other protruding portion at the tilted surface, which is tilted relative to the arrangement direction when viewed in the up-and-down direction (a direction perpendicular to the mounting surface of the circuit board). At this point, the sloped surface may be formed on either one protruding portion or the other protruding portion, or may be formed on the both protruding portions.

What is claimed is:

1. An electrical connector to be mounted on a circuit board, comprising:

a plurality of connecting members arranged in an arrangement direction; and a joining member extending in the arrangement direction for holding an end portion of each of the connecting members so that the joining member joins all of the connecting members, wherein each of said connecting members includes a terminal to be connected to a mating connector, and a terminal holding member for holding the terminal, said connecting members are arranged so that the connecting members arranged adjacently form a gap in between, and said joining member is formed of a material having a coefficient of thermal expansion the same as that of the circuit board.

2. The electrical connector according to claim 1, wherein said connecting members are arranged so that the connecting members arranged adjacently form the gap greater than a thermal expansion amount of the circuit board in the arrangement direction.

3. The electrical connector according to claim 1, wherein said terminal holding member includes a protruding portion protruding in the arrangement direction, and said protruding portion is arranged to abut against another protruding portion of the terminal holding member situated adjacently so that the connecting members are properly positioned.

4. The electrical connector according to claim 3, wherein said protruding portion includes an inclined surface inclined relative to the arrangement direction so that the inclined surface abuts the another protruding portion of the terminal holding member situated adjacently.

5. The electrical connector according to claim 3, wherein said protruding portion is disposed at each of a plurality positions on both side surfaces of each of the connecting members, and at least one of the protruding portions disposed at the plurality positions on one of the both side surfaces is situated at a location different from those of the protruding portions disposed at the plurality positions on the other of the both side surfaces.

6. The electrical connector according to claim 1, wherein each of said connecting members includes a held portion at the end portion thereof, and said joining member includes a groove portion for inserting the held portion therein.

7. The electrical connector according to claim 1, wherein each of said connecting members includes a grounding plate extending in a direction perpendicular to the arrangement direction.

* * * * *